US008387978B2

(12) United States Patent
Fukasawa et al.

(10) Patent No.: US 8,387,978 B2
(45) Date of Patent: Mar. 5, 2013

(54) RECORDING APPARATUS AND MEDIUM TRANSPORTING METHOD

(75) Inventors: Jun Fukasawa, Hata-machi (JP); Hiroshi Katayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1205 days.

(21) Appl. No.: 11/897,434

(22) Filed: Aug. 30, 2007

(65) Prior Publication Data

US 2008/0063449 A1 Mar. 13, 2008

(30) Foreign Application Priority Data

Aug. 31, 2006 (JP) ..... 2006-236904
Aug. 31, 2006 (JP) ..... 2006-236905

(51) Int. Cl.
*B65H 5/34* (2006.01)
*B65H 83/00* (2006.01)

(52) U.S. Cl. ..... 271/270; 271/3.16

(58) Field of Classification Search ..... 271/270, 271/3.14, 3.18, 264
See application file for complete search history.

(56) References Cited

U.S. PATENT DOCUMENTS

| | | | | |
|---|---|---|---|---|
| 4,451,027 | A * | 5/1984 | Alper | 271/10.02 |
| 6,206,359 | B1 * | 3/2001 | Hirota et al. | 271/3.15 |
| 6,378,864 | B1 * | 4/2002 | Iesaka | 271/270 |
| 6,533,263 | B2 * | 3/2003 | Tamura | 271/10.01 |
| 6,783,290 | B2 * | 8/2004 | Sussmeier | 400/608.4 |
| 6,909,857 | B2 * | 6/2005 | Tanaka | 399/45 |
| 6,968,136 | B2 * | 11/2005 | Tanaka | 399/45 |
| 7,040,616 | B2 * | 5/2006 | Stemmle | 271/270 |
| 7,559,549 | B2 * | 7/2009 | Clark et al. | 271/270 |
| 7,722,036 | B2 * | 5/2010 | Saitsu | 271/270 |
| 7,810,811 | B2 * | 10/2010 | Suzuki et al. | 271/270 |
| 2006/0255535 | A1 * | 11/2006 | Takano | 271/270 |
| 2007/0194521 | A1 * | 8/2007 | Matsumoto et al. | 271/270 |

FOREIGN PATENT DOCUMENTS

| | | |
|---|---|---|
| JP | 11-334905 | 12/1999 |
| JP | 2001-341898 | 12/2001 |
| JP | 2005-096450 | 4/2005 |
| JP | 2006-117385 | 5/2006 |

* cited by examiner

*Primary Examiner* — Patrick Cicchino
(74) *Attorney, Agent, or Firm* — Nutter McClennen & Fish LLP; John J. Penny, Jr.; Christina M. Sperry

(57) ABSTRACT

Disclosed herein is a recording apparatus including a control device which controls a transportation of a medium by controlling a feeding device and a transporting device; under the control of the control device, the feeding device is stopped or decelerated when a previous medium is transported to a predetermined position, and a next medium is accelerated by the feeding device so as to continuously transport the previous medium and the next medium when a gap between those becomes a predetermined distance, the speed of the transporting device is changed from a first transporting speed to a second transporting speed when the previous medium passes through the predetermined position, under a condition that the first transporting speed of the previous medium is different from the second transporting speed of the next medium by the feeding device.

10 Claims, 12 Drawing Sheets

FIG. 3

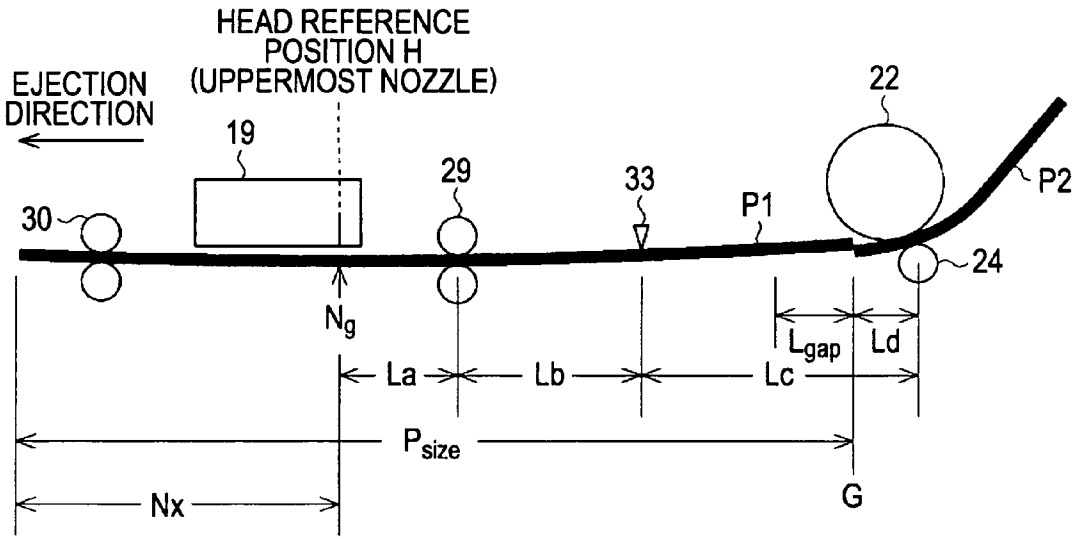

La: DISTANCE BETWEEN UPPERMOST NOZZLE AND NIP POINT OF PAPER TRANSPORTING ROLLER

Lb: DISTANCE BETWEEN NIP POINT OF PAPER TRANSPORTING ROLLER AND PAPER DETECTION SENSOR

Lc: DISTANCE BETWEEN PAPER DETECTION SENSOR AND NIP POINT OF FEEDING ROLLER

Ld: DISTANCE OF FRONT END OF NEXT PAGE JUMPED OUT FROM NIP POINT OF FEEDING ROLLER $L_{gap}$: DISTANCE BETWEEN PAGES $P_{size}$: DISTANCE OF SHEET SPECIFIED BY PRINTER DRIVER Nx: PAPER TRANSPORTING AMOUNT (COUNT VALUE OF PAPER TRANSPORTING AMOUNT COUNTER)

ACCELERATION/ DECELERATION TABLE VT1 OF TARGET VELOCITY V1

| DISTANCE D | PERIOD T |
|---|---|
| 0 | 429 |
| 1 | 427 |
| 2 | 425 |
| 3 | 422 |
| 4 | 420 |
| 5 | 418 |
| 6 | 416 |
| ⋮ | ⋮ |
| ⋮ | ⋮ |
| Da1 | T1 |

ACCELERATION TABLE VTa1

ACCELERATION/ DECELERATION TABLE VT2 OF TARGET VELOCITY V2

| DISTANCE D | PERIOD T |
|---|---|
| 0 | 429 |
| 1 | 427 |
| 2 | 425 |
| 3 | 422 |
| 4 | 420 |
| 5 | 418 |
| 6 | 416 |
| ⋮ | ⋮ |
| ⋮ | ⋮ |
| Da2 | T2 |

ACCELERATION TABLE VTa2

| DISTANCE D | PERIOD T |
|---|---|
| 0 | T1 |
| 1 | ⋮ |
| 2 | ⋮ |
| 3 | ⋮ |
| 4 | ⋮ |
| ⋮ | ⋮ |
| ⋮ | ⋮ |
| Db1 | 429 |

DECELERATION TABLE VTb1

| DISTANCE D | PERIOD T |
|---|---|
| 0 | T2 |
| 1 | ⋮ |
| 2 | ⋮ |
| 3 | ⋮ |
| 4 | ⋮ |
| ⋮ | ⋮ |
| ⋮ | ⋮ |
| Db2 | 429 |

DECELERATION TABLE VTb2

ACCELERATION TABLE VTa1 OF TARGET VELOCITY V1

| DISTANCE D | PERIOD T |
|---|---|
| 0 | 429 |
| 1 | 427 |
| 2 | 425 |
| 3 | 422 |
| ⋮ | ⋮ |
| ⋮ | ⋮ |
| Da1 | T1 |

CONSTANT VELOCITY PERIOD

| T1 |
|---|

ACCELERATION TABLE VTa2 OF TARGET VELOCITY V2

| DISTANCE D | PERIOD T |
|---|---|
| 0 | 429 |
| 1 | 427 |
| 2 | 425 |
| 3 | 422 |
| ⋮ | ⋮ |
| ⋮ | ⋮ |
| D1 | T1 |
| ⋮ | ⋮ |
| ⋮ | ⋮ |
| Da2 | T2 |

RECORDING APPARATUS AND MEDIUM TRANSPORTING METHOD

CROSS REFERENCES TO RELATED APPLICATIONS

This application is based on Japanese Patent Application No. 2006-236904 filed on Aug. 31, 2006 and Japanese Patent Application No. 2006-236905 filed on Aug. 31, 2006, in the Japanese Patent Office, the entire content of which is hereby incorporated by reference.

BACKGROUND

1. Technical Field

The present invention relates to a recording apparatus for feeding and transporting a medium and recording data on the medium which is being transported and a medium transporting method.

2. Related Art

In the related art, a printer which is a recording apparatus includes an auto sheet feeder (hereinafter, referred to as ASF) (for example, see JP-A-2005-96450). When a printing operation starts, a sheet of paper stored in the ASF is fed by the driving of the ASF and a front end of the sheet is automatically positioned at a printing start position.

The ASF starts the feeding of a next sheet after a previous sheet has been fed and ejected. However, in this feeding method, since the feeding operation of the next sheet starts after the previous sheet has been ejected, a gap between the previous sheet and the next sheet exists and a relatively long standby time occurs between the completion of a printing operation of the previous sheet and the start of a printing operation of the next sheet. Accordingly, printing throughput deteriorates.

In order to solve this problem, JP-A-2005-96450 discloses a printing apparatus (recording apparatus) for consecutively transporting a previous sheet and a next sheet with a predetermined gap between the previous sheet and the next sheet. According to this printing apparatus, an ejection operation of the previous sheet and a feeding operation of the next sheet are simultaneously performed so as to reduce a standby time between the completion of a printing operation of the previous sheet and the start of a printing operation of the next sheet. Accordingly, it is possible to improve printing throughput.

In order to detect the front end of the fed sheet, a paper detection sensor for detecting a front end of the sheet is provided between a feeding roller and a paper transporting roller of the ASF. However, if the sheets are consecutively fed such that a gap is not ensured between the previous sheet and the next sheet, the paper detection sensor cannot detect the front end of the sheet. In addition, sheets may be double fed in a state in the rear end of the previous sheet and the front end of the next sheet partially overlap. Accordingly, even when the sheets are consecutively fed, a predetermined gap should be maintained between the previous sheet and the next sheet.

For example, in JP-A-2005-96450, in order to prevent double feeding of the sheets, the transport of the next sheet (a recording sheet of a next page) starts after the rear end of the previous sheet (a recording sheet of a current page) passes through the transport roller such that the previous sheet and the next sheet are prevented from being double fed. That is, after the rear end of the previous sheet passes through the transport roller, the next sheet is transported. When the previous sheet is transported, the next sheet is transported by the same transport amount as the previous sheet.

However, JP-A-2005-96450 does not describe a transport speed.

SUMMARY

An advantage of some aspects of the invention is that it provides a recording apparatus and a medium transporting method, which are capable of consecutively feeding sheets while a necessary gap is maintained between a previous medium and a next medium and improving throughput even when a transport speed needs to be changed.

According to an aspect of the invention, there is provided a recording apparatus including a feeding device for feeding a medium, a transporting device for transporting the medium fed by the feeding device, and a recording device for recording data on the medium which is transported by the transporting device, the recording apparatus including: a control device which controls the feeding device and the transporting device such that a previous medium which is first fed is transported by the feeding device and the transporting device, the previous medium is transported to a predetermined position where the medium is no longer being transported by the feeding device, and acceleration of a next medium starts by the feeding device so as to continuously transport the previous medium and the next medium after the feeding device is stopped or decelerated such that a gap between the previous medium and the next medium becomes a predetermined size, wherein, when the previous medium passes through the predetermined position, under a condition that a first transporting speed which is a transporting speed of the previous medium by the feeding device and the transporting device, and a second transporting speed which is a transporting speed of the next medium by the feeding device after the acceleration of the next medium has been started by the feeding device or a transporting speed of the previous medium by the transporting device are different, the control device controls the speed of the transporting device from the first transporting speed to the second transporting speed.

By this configuration, when the previous medium transported by the feeding device and the transporting device is transported to the predetermined position where the medium is not transported by the feeding device, the acceleration of the next medium by the feeding device starts after the feeding device is stopped or decelerated such that the gap between the previous medium and the next medium becomes the predetermined size. The control device controls the speed of the transporting device from the first transporting speed to the second transporting speed, in the condition that the first transporting speed of the previous medium transported by the feeding device and the transporting device and the second transporting speed which is the transporting speed of the next medium by the feeding device after the acceleration of the next medium, which is performed after the gap between the previous medium and the next medium becomes the predetermined size, starts by the feeding device or the transporting speed of the previous medium by the transporting device are different. The feeding device and the transporting device need to cooperate with each other such that excessive looseness or excessive tension is not applied to the medium while the medium is transported by the feeding device and the transporting device, that is such that the feeding device and the transporting device so as to substantially have the same transporting speed, but do not need to cooperate with each other after the previous medium is transported to the position where the medium is not transported by the feeding device. When the cooperation is not required, the transporting speed of the previous medium is changed from the first transporting speed to the second transporting speed. For example, if the second transporting speed is higher than the first transporting speed, the speed of the transporting device is changed from the first transporting speed to the second transporting speed such that the transport of the previous sheet is early finished and the next recording early starts. Accordingly, since the previous medium and the next medium can be continuously transported at the necessary gap and the transporting speed can be increased, throughput can be improved. In addition, a method of changing the speed from the first transporting speed to the second transporting speed includes a method of giving pause to the transporting device when the speed of the transporting device from the first transporting speed to the second transporting speed. However, in the invention, since the speed of the transporting device is changed without pausing, throughput can be improved compared with the configuration in which the transporting device pauses when the speed of the transporting device is changed.

In the recording apparatus according to the invention, the first transporting speed may be the transporting speed of the feeding device and the transporting device when the previous medium is transported by the feeding device and the transporting device so as to pause at the predetermined position or when the previous medium is transported without pausing from a pause position immediately before being transported to the predetermined position, and the second transporting speed may be any one of the transporting speed of the feeding device when the next medium is accelerated by the feeding device after the gap between the previous medium and the next medium becomes the predetermined size and is transported to a next pause position without pausing and the transporting speed of the transporting device when the previous medium is transported from a position, in which a speed is 0, to a next pause position without pausing, along an extension of an acceleration gradient in which acceleration from the first transporting speed starts from at least an acceleration start position after the predetermined position, and the control device may perform a control which satisfies a relationship in which the second transporting speed is higher than the first transporting speed before distance.

By this configuration, the previous medium is transported at the first transporting speed by the feeding device and the transporting device when the previous medium is transported by the feeding device and the transporting device so as to pause at the predetermined position or when the previous medium is transported without pausing from the pause position immediately before being transported to the predetermined position. The next medium is transported at the second transporting speed by the feeding device when the next medium is accelerated by the feeding device after the gap between the previous medium and the next medium becomes the predetermined size and is transported to the next pause position without pausing. Alternatively, the previous medium is transported at the second transporting speed by the transporting device when the previous medium is transported from the position, in which the speed is 0, to the next pause position without pausing, on the extension of the acceleration gradient in which acceleration from the first transporting speed starts from at least an acceleration start position after the predetermined position. The control device performs the control which satisfies the relationship in which the second transporting speed is higher than the first transporting speed. That is, if the feeding device satisfies the relationship that the second transporting speed of the feeding device for transporting the next medium is higher than the first transporting speed or if the transporting devices satisfies the relationship that the second transporting speed of the feeding device for transporting the previous medium is higher than the first transporting speed, the control device change the speed of the transporting device from the first transporting speed to the second transporting speed.

The recording apparatus according to the invention may further include a storage device for storing the first speed control data which is set according to the position value and has the first transporting speed as a target speed and the second speed control data which is set according to the position value and has the second transporting speed as the target speed, wherein the control device may switch referred speed control data from one of the first speed control data to one of the second speed control data corresponding thereto in an acceleration process when the speed is changed from the first transporting speed to the second transporting speed.

By this configuration, the control for changing from the first transporting speed to the second transporting speed is performed by switching the referred speed control data from one of the first speed control data to one of the second speed control data corresponding thereto in the acceleration process. Accordingly, speed control data for changing the speed is not required. For example, a target speed of the first speed control data is preferably switched to a target speed of the second speed control data in the acceleration process.

In the recording apparatus according to the invention, the control device may search for the second speed control data and acquire a position where the same speed as the target speed of the first speed control data is set, control the speed of the transporting device according to the first speed control data when the previous medium passes through the predetermined position, accelerate the transporting device to the first transporting device, maintain the first transporting speed at a constant speed, and controls the speed of the transporting device from a predetermined acceleration start position passing through an area in which the medium is transported by the feeding device and the transporting device after the position value obtained by searching according to the second speed control data.

By this configuration, the second speed control data is searched for, the position where the same speed as the target speed of the first speed control data is acquired, and, when the medium reaches the predetermined acceleration start position during the constant speed range after acceleration to the first transporting speed, the speed is changed from the first transporting speed to the second transporting speed by controlling the speed after the position value obtained by the searching according to the second speed control data. Since the speed is changed by the combination of two pieces of speed control data, speed control data for changing the speed does not need to be prepared.

The recording apparatus according to the invention may further include a storage device for storing speed control data in which a speed is set according to a position value in a process of changing from the first transporting speed to the second transporting speed, and the control device may change the speed of the previous medium from the first transporting speed to the second transporting speed by controlling the transporting device to the speed according to the position value in the speed control data in the speed changing process.

By this configuration, the control of the speed from the first transporting speed to the second transporting speed is performed by controlling the transporting device to the speed according to the position value according to the speed control data in the speed changing process. Since the speed control data in the speed changing process is used, a special process such as a combination of two pieces of speed control data does not need to be performed.

The recording apparatus according to the invention may further include a storage device for storing data of an equation which can calculate a speed according to a position value in a process of changing the first transporting speed to the second transporting speed, and the control device may control the change of the speed by controlling the transporting device to the speed calculated according to the position value using the equation in the speed changing process.

By this configuration, the change of the speed from the first transporting speed to the second transporting speed is controlled by controlling the transporting device to the speed calculated according to the position value using the equation stored in the storage device. Since the speed according to the position value is calculated, the data of the equation having a relatively small data capacity is stored in the storage device.

In the recording apparatus according to the invention, the control device may not change the speed of the transporting device from the first transporting speed to the second transporting speed under a condition that the second transporting speed is lower than the first transporting speed.

By this configuration, in the condition that the second transporting speed is lower than the first transporting speed, the change of the speed is not performed and the previous medium is transported at the first transporting speed. Accordingly, throughput can be improved.

The recording apparatus according to the invention may further include a first driving source which drives the feeding device; and a second driving source which drives the transporting device, and the control device may control the driving of the first driving source and the second driving source.

By this configuration, since the feeding device and the transporting device are driven by different driving sources, it is easy to individually control the feeding device and the transporting device.

In the recording apparatus according to the invention, the second transporting speed may depend on a transporting distance from the predetermined position to the next pause position of the first driving source or a transporting distance from the position in which the speed is 0 to the next pause position of the second driving source.

By this configuration, since the second transporting speed depends on the transporting distance from the predetermined position to the next pause position of the first driving source or the transporting distance from the position, in which the speed is 0, on the extension of the acceleration gradient to the next pause position of the second driving source, the medium can be transported at a high speed a case where the transporting distance is relatively large, compared with a case where the transporting distance is relatively small.

In the recording apparatus according to the invention, a minimum distance corresponding to a sum of a movement distance necessary for acceleration to the transporting speed and a movement distance necessary for deceleration from the transporting speed may be determined, and the control device may select a high transporting speed among the transporting speeds satisfying that a transporting distance from a transport start position which passes through the predetermined position to a position where the speed is changed from the first transporting speed to the second transporting speed is equal to or larger than the minimum distance and determine the first transporting speed.

By this configuration, since the highest speed is selected from the transporting speeds satisfying that the transporting distance is equal to or larger than the minimum distance, it is possible to transport the previous medium at the high transporting speed.

In the recording apparatus according to the invention, the first transporting speed may be determined by selecting a low speed among the transporting speeds separately determined by the feeding device and the transporting device and the second transporting device may be determined by selecting a highest speed among the transporting speed satisfying that a residual transporting distance in which the medium is transported at the first transporting speed is equal to or larger than the minimum distance.

By this configuration, even when the first transporting speed is suppressed to a low speed from the minimum distance condition and the condition that the feeding device and the transporting device substantially have the same transporting speed, the speed can be changed from the first transporting speed to the second transporting speed and thus throughput can be improved.

According to another aspect of the invention, there is provided a medium transporting method of a recording apparatus including a feeding device for feeding a medium, a transporting device for transporting the medium fed by the feeding device, and a recording device for recording data on the medium which is transported by the transporting device, the method including: when a previous medium is transported from a position in an area in which the previous medium which is first fed is transported by the feeding device and the transporting device so as to pass through a predetermined position where the medium is not transported by the transporting device, transporting the previous medium by the feeding device and the transporting device, transporting the previous medium to the predetermined position where the medium is not transported by the transporting device, and pausing and decelerating the feeding device, controlling driving of the feeding device and the transporting device such that acceleration of a next medium starts by the feeding device so as to continuously transport the previous medium and the next medium after a gap between the previous medium and the next medium becomes a predetermined size, and changing from a first transporting speed to a second transporting speed, under a condition that the first transporting speed of the previous medium transported by the feeding device and the transporting device, and the second transporting speed which is a transporting speed of the next medium by the feeding device after the acceleration of the next medium has been started by the feeding device or a transporting speed of the previous medium by the transporting device are different.

BRIEF DESCRIPTION OF THE DRAWINGS

The invention will be described with reference to the accompanying drawings, wherein like numbers reference like elements.

FIG. 3 is a schematic side view showing a transport mechanism for transporting a sheet from the ASF.

DESCRIPTION OF EXEMPLARY EMBODIMENTS

Figure 1A:
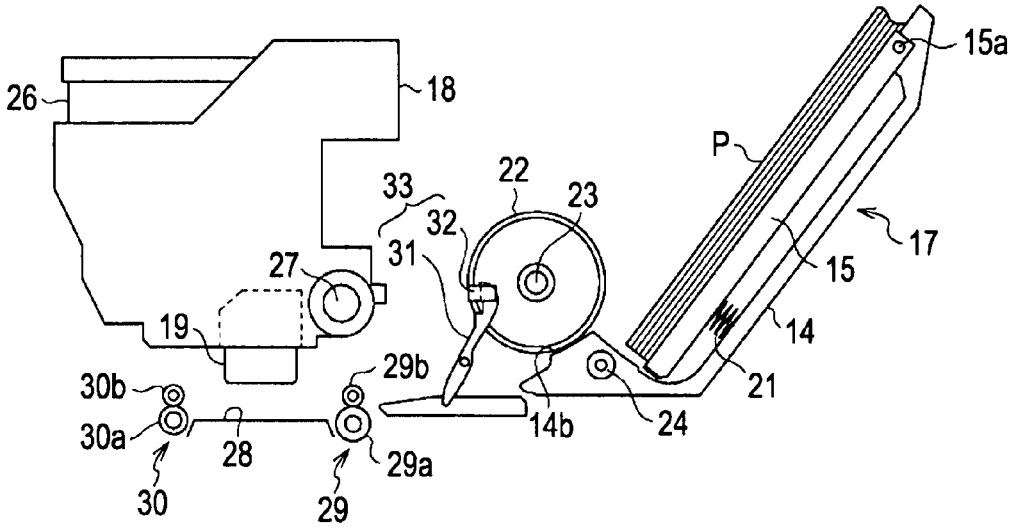
FIGS. 1A and 1B are schematic side views illustrating an operation of an auto sheet feeder (ASF) of an embodiment of the invention.

Hereinafter, a printer according to an embodiment of the invention will be described with reference to FIGS. 1 to 14. FIG. 2 is a perspective view of the printer according to the present embodiment.

The printer 11 which is a recording apparatus is, for example, an ink jet printer. The printer 11 includes an auto sheet feeder (hereinafter, referred to as an ASF 13) which is mounted at a rear surface side of a main body 12 and functions as a feeding device for feeding a sheet of paper P as a medium. The ASF 13 includes a feeding tray 14, a hopper 15, an edge guide 16, and a sheet guide 17 including a sheet support 14*a*. The ASF 13 includes a feed driving mechanism for feeding sheets stored in the sheet guide 17 to the main body 12 one by one.

The main body 12 includes a carriage 18 which reciprocally moves in a main scanning direction (an X direction of FIG. 2) and a recording head 19 mounted on a lower surface of the carriage 18. The sheet P is printed by alternately repeating a recording operation for injecting ink from the recording head 19 to the sheet P and a sheet transporting operation for transporting the sheet P in a sub-scanning direction Y by a predetermined transport amount while the carriage 18 is moved in the main scanning direction X. The printed sheet P is ejected through an ejection port 12A which is formed in a lower side of a front surface of the main body 12. A recording device is configured by the carriage 18 and the recording head 19.

FIG. 1 shows the ASF and a paper feeder. As shown in FIG. 1, the hopper 15 is supported on the upper surface of the feeding tray 14, which is obliquely mounted at the rear surface side of the main body, such that the hopper is rotated around a shaft 15*a* located at an upper end thereof in a predetermined angle range. The hopper 15 is energized in a direction facing away the feeding tray 14 by a compression spring 21 interposed between the feeding tray 14 and the hopper 15.

A cylindrical feeding roller 22 is mounted in the vicinity of a lower end of the hopper 15 to be rotated around a rotary shaft 23. The hopper 15 is reciprocally moved between a withdrawn position shown in FIG. 1A and a feeding position shown in FIG. 1B.

A guide portion 14*b* is provided on the upper surface of a downstream end (a left end, in FIG. 1) of the feeding tray 14. A retardation roller 24 is provided at a position opposite to the feeding roller 22 in the vicinity of an upper end of the guide portion 14*b*. The retardation roller 24 is driven and rotated in a state in which a rotation load is applied by a torque limiting mechanism such as a torque limiter and can be moved close to and away from the feeding roller 22. In the present embodiment, the hopper 15 and the retardation roller 24 operate in interlock with each other.

The carriage 18 having an ink cartridge 26 mounted therein is provided at a downstream side of the ASF 13 in a sheet transporting direction to be moved along with a guide shaft 27 in the main scanning direction X (perpendicular to the paper surface of FIG. 1). A platen 28 is provided below the recording head 19 at a predetermined gap. A paper transporting roller 29 and an ejection roller 30 are provided with the platen 28 interposed therebetween in the sub-scanning direction (horizontal direction of FIG. 1).

The paper transporting roller 29 includes a pair of a transport driving roller 29*a* and a transport driven roller 29*b* and the ejection roller 30 includes a pair of an ejection driving roller 30*a* and an ejection driven roller 30*b*. In the present embodiment, the transport driving roller 29*a* and the ejection driving roller 30*a* are driven by a PF motor 58 (a paper transporting motor) (see FIG. 5) to transport and eject the sheet P in cooperation with each other. The feeding roller 22 is driven by an ASF motor 56 (feeding motor) (see FIG. 5) to feed and transport the sheet P in cooperation with the paper transporting roller 29.

A paper detection sensor 33 including a lever 31 which extends such that a lower end thereof reaches a sheet transporting path and an optical sensor portion 32 for detecting an upper end of the lever 31 are provided between the feeding roller 22 and the paper transporting roller 29. The paper detection sensor 33 is deactivated when the lever 31 is positioned at an original position shown in FIG. 1A by an energization force of a spring in a state in which the sheet P which presses the lower end of the lever 31 is not present, and is activated when a sheet P1 presses the lower end of the lever 31 and the lever 31 is rotated during feeding as shown in FIG. 1B. In more detail, the sensor portion 32 includes a light-emitting portion and a light-receiving portion, the lever 31 which blocks the light emitted from the light-emitting portion is pressed by the sheet P1 and is rotated, and the light-receiving portion receives the emitted light, thereby activating the paper detection sensor 33.

Figure 1B:
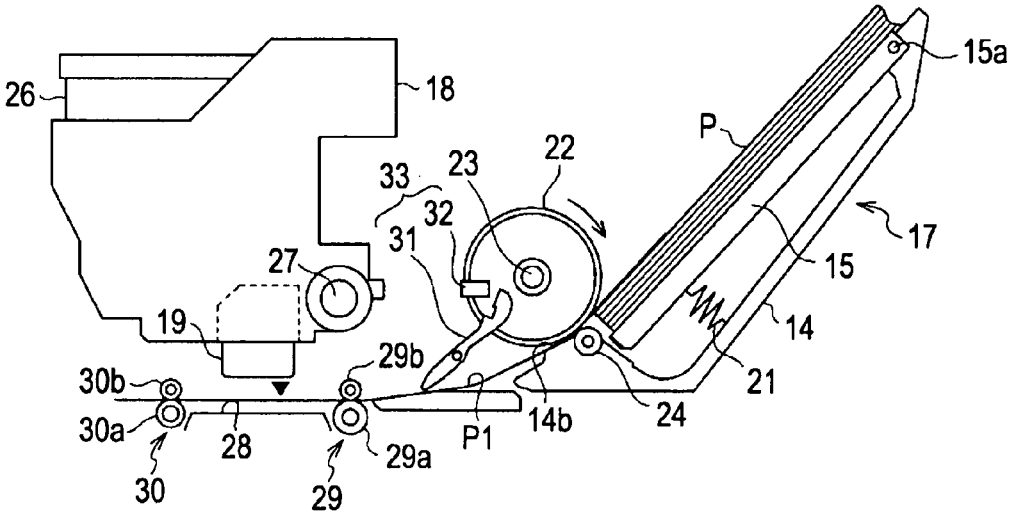
Figure 2:
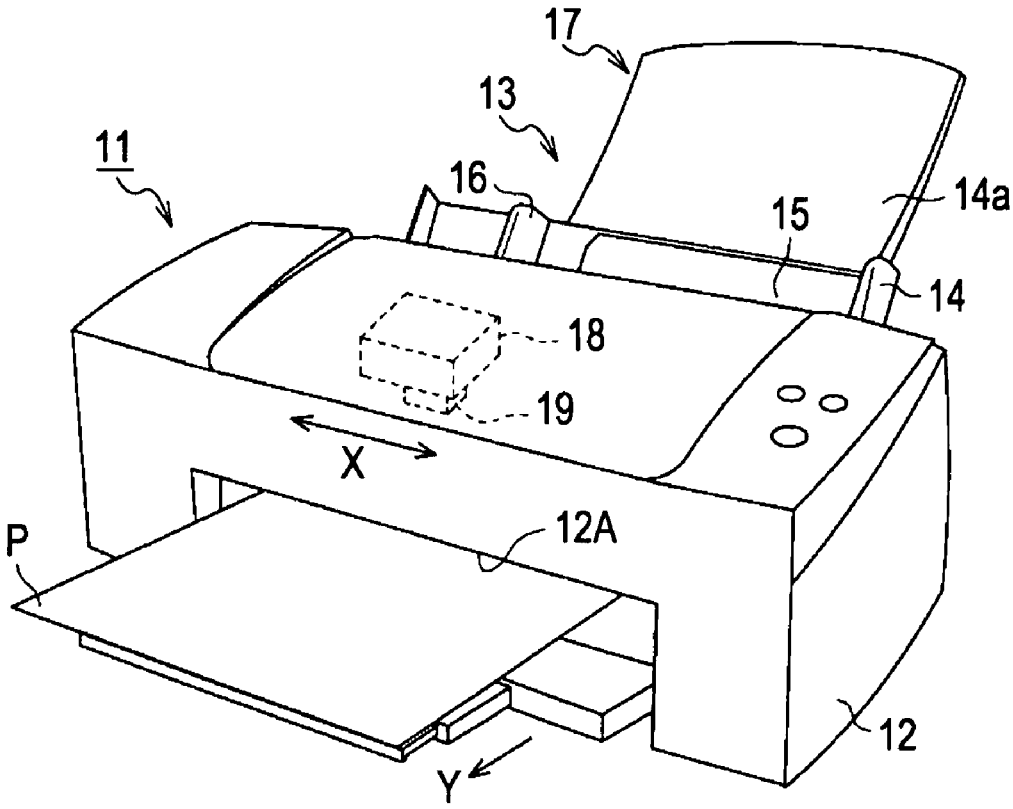
FIG. 2 is a perspective view of a printer.

The retardation roller 24 can be moved upward or downward between the withdrawn position separated from an outer circumferential surface of the feeding roller 22 as shown in FIG. 1A and the feeding position which contacts the outer circumferential surface of the feeding roller 22 as shown in FIG. 1B. At the time of a standby state shown in FIG. 1A in which printing is not performed, the retardation roller 24 is moved downward and is positioned at the withdrawn position separated from the feeding roller 22. At the time of printing shown in FIG. 1B, the retardation roller 24 is moved upward and is positioned at a position where the sheet is nipped between the feeding roller 22 and the retardation roller 24, the hopper 15 is rotated in the energization direction of the compression spring 21 in interlock with the retardation roller 24, and the sheets P laminated on the hopper 15 are pressed on the feeding roller 22.

Among the sheets P pressed onto the feeding roller 22 by moving the hopper 15 upward, the uppermost sheet is fed and inserted between the feeding roller 22 and the retardation roller 24 by the rotation of the feeding roller 22. In the feeding operation, only the uppermost sheet P1 of the sheets P pressed onto the feeding roller 22 is separated from the other sheets and is fed by balancing the rotation resistance of the retardation roller 24, friction resistance of the circumferential surface of the feeding roller 22, and the friction resistance of the surface of the sheet P.

The retardation roller 24 and the hopper 15 return to the withdrawn position when a sheet which will be subsequently fed is not present after the front end of the sheet is detected. Accordingly, when the sheet which will be subsequently fed is present, the hopper 15 and the retardation roller 24 are held at the feeding position shown in FIG. 1B. Accordingly, the sheets are consecutively fed with a small gap therebetween.

When the feeding roller 22 is continuously rotated, a previous sheet P1 and a next sheet P2 are continuously fed without a gap therebetween. However, if the predetermined gap is not ensured between the previous sheet P1 and the next sheet P2, the lever 31 is not returned to the original position shown in FIG. 1A even when the rear end of the previous sheet P1 passes through the lower end of the lever 31 of the paper detection sensor 33, and thus the front end of the next sheet P2 cannot be detected.

A method of ensuring a gap between the sheets P1 and P2 may include a method of moving the hopper 15 and the retardation roller 24 to the withdrawn position when the previous sheet P1 is not nipped between the feeding roller 22 and the retardation roll 24. However, according to this method, the feeding start time of the next sheet is delayed while the hopper 15 and the retardation roller 24 retreat such that a gap is formed between the previous sheet and the next sheet. However, even when the sheet withdraws in a short time of 1 second or less, at the time of the ejection of a sheet or the feed of a relatively long sheet, the gap between the previous sheet and the next sheet is excessively widened and thus printing throughput deteriorates. Accordingly, in the present embodiment, the hopper 15 and the retardation roller 24 are maintained at the feeding position. The present embodiment employs an interpage control method which is a transport control method for ensuring the gap between the previous sheet and the next sheet. The interpage control method will be described later.

The front end of the fed sheet P1 passes through the paper transporting roller 29 to reach a print start position between the carriage 18 and the platen 28. A plurality of nozzles (nozzle group) for ejecting ink are formed in the lower surface of the recording head 19 and the position of a nozzle (upstream nozzle) located at an upstream side of the nozzle group in a transporting direction is a head reference position (position denoted by "▼" in FIG. 1B). The sheet P1 is transported to a position where the print start position of the sheet is identical to the head reference position such that the front end of the sheet P1 is detected.

A sheet detection position is determined according to a layout condition with or without a margin (top margin) for determining the print start position of the sheet and a transporting distance is determined according to the sheet detection position at the time of feeding the sheet. After the sheet P1 has been fed (that is, after the front end of the sheet has been detected), a printing operation and a paper transporting operation of the recording head 19 are alternately performed to perform printing.

In the present embodiment, the transport of the sheet until the front end of the fed sheet is detected is defined as a "feeding operation", the transport of the sheet until the detected sheet is printed is defined as a "paper transporting operation", and the transport of the sheet until the rear end of the printed sheet is no longer detected by the paper detection sensor 33 is defined as an "ejecting operation". When the sheet is transported from a time point when printing is finished to a time point when the rear end of the sheet is no longer detected by the paper detection sensor 33, the ejecting operation of the sheet is not performed and the feeding operation of a next sheet is performed. The ejection roller 30 is rotated in interlock with the feeding operation such that the previous sheet is ejected.

FIG. 3 is a schematic side view of the ASF and the paper feeder (PF). A variety of positions and distances defined in the interpage control process will be described with reference to FIG. 3. The position of an uppermost nozzle of the recording head 19 is the head reference position H. A distance between the head reference position H (uppermost nozzle) and a nip point of the paper transporting roller is La, a distance between the nip point of the paper transporting roller and the paper detection sensor 33 is Lb, and a distance between the paper detection sensor 33 and a nip point of the feeding roller (a nip point between the feeding roller 22 and the retardation roller 24) is Lc.

When the previous sheet P1 is transported to the position of FIG. 3, the sheet P1 is released from the nip of the feeding roller 22. After the sheet is transported to the position of FIG. 3, the feeding roller 22 and the paper transporting roller 29 (or the ejection roller 30) do not need to be driven at the same transporting speed for transporting the sheet. That is, while the rear end of the sheet P1 is nipped by the feeding roller 22, the sheet P1 is nipped by the feeding roller 22 and the paper transporting roller 29 at the time of transporting the sheet P1. In this period, the feeding roller 22 and the paper transporting roller 29 need to be simultaneously driven the same speed. This is because, if the rollers are not driven at the same speed, the previous sheet P1 is may be excessively stretched or loosened at a portion between the feeding roller 22 and the paper transporting roller 29 and thus inadequately transported.

However, since the previous sheet P1 and the next sheet P2 are separately transported after the end (rear end) of the upstream side of the transporting direction of the sheet P1 is released from the nip of the feeding roller 22, the feeding roller 22 and the paper transporting roller 29 do not need to be simultaneously driven. In the present embodiment, when the rear end of the previous sheet P1 is released from the nip of the feeding roller 22, the rotation of the feeding roller 22 pauses, the sheet P1 is transported by the paper transport roller 29 during the pause such that the gap between the previous sheet P1 and the next sheet P2 is ensured, the rotation of the feeding roller 22 is resumed, and the feeding of the next sheet P2 is resumed. By performing the interpage control process, the necessary gap between the sheets P1 and P2 is ensured. When the gap between the sheets P1 and P2 is ensured, the paper detection sensor 33 is deactivated by the gap and the paper detection sensor 33 is then activated by detecting the front end of the next sheet P2. Thus, the next sheet P2 can be detected by the paper detection sensor 33. Accordingly, the front end of the next sheet P2 which is transported from the reference position by a predetermined distance can be detected on the basis of the position detected by the paper detection sensor 33.

After the previous sheet P1 is released from the nip by the feeding roller 22, an interpage control position G which is a stop position where the rotation of the feeding roller 22 is stopped is set to a position where the front end of the next sheet P2 has exited from the nip point of the feeding roller by a distance Ld. The distance Ld corresponds to a margin in which the feeding roller 22 can be stopped after the previous sheet P1 is released from the nip of the feeding roller 22. When the rear end of the previous sheet P1 reaches the interpage control position G, a position of the sheet P1 opposed to the head reference position H is called an interpage control position Ng. In the present embodiment, since the position of the sheet P1 is managed so as to be opposite to the head reference position H, when the position of sheet P1 separated from the rear end thereof by a distance (La+Lb+Lc−Ld) in the downstream side of the transporting direction reaches the head reference position H, it is determined that the sheet reaches the interpage control position Ng where the rear end of the sheet reaches the interpage control position G.

In FIG. 3, a distance $L_{gap}$ is a distance (hereinafter, referred to as a gap distance $L_{gap}$) by which the sheets P1 and P2 are separated. After the sheet P1 is transported from the interpage control position by the gap distance $L_{gap}$, the rotation of the feeding roller 22 which makes a pause is resumed. A reference numeral $P_{size}$ is a sheet distance (transporting direction distance) specified by a printer driver. A position obtained by subtracting a distance (La+Lb+Lc−Ld) from the sheet distance $P_{size}$ is the interpage control position Ng. Accordingly, the interpage control position Ng indicated by a distance Nx from the front end of the sheet P1 varies according to the sheet distance $P_{size}$. Here, the reference numeral Nx denotes the paper transport amount of the sheet P1 from the position where the front end of the sheet P1 reaches the head reference position H. In the present embodiment, the transporting distance (paper transporting amount) of the sheet from the time point when the front end of the sheet P1 reaches the head reference position H is counted by a paper transporting amount counter 65 (see FIG. 5) so as to manage the position of the sheet P1 using the count value. When the paper transporting amount Nx which is the count value of the paper transporting amount counter 65 reaches the value Ng which is $P_{size}$−(La+Lb+Lc−Ld), it is determined that the sheet P1 reaches the interpage control position Ng.

Next, the electrical configuration of the printer will be described with reference to FIG. 5.

Figure 5:
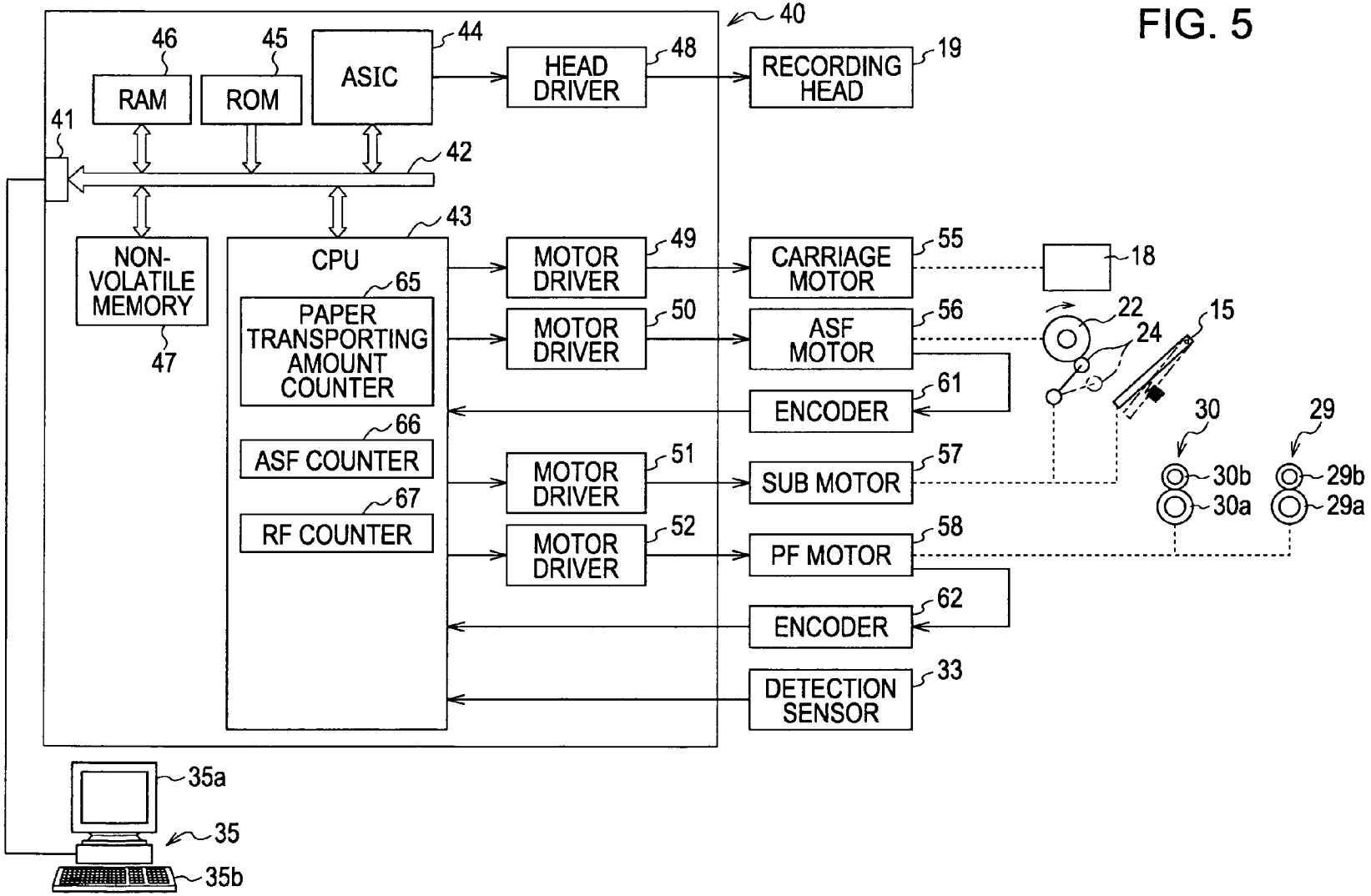
FIG. 5 is a block diagram showing an electrical configuration of the printer.

As shown in FIG. 5, the printer 11 includes a controller 40 for performing a variety of controls. The controller 40 includes an interface 41 connected to a host computer 35 (PC). A bus 42 connected to the interface 41 is connected to a CPU 43, an application specific integrated circuit (ASIC) 44, a ROM 45, a RAM 46, and a non-volatile memory 47. The CPU 43 executes a program stored in the ROM 45 to perform a feeding control, a paper transporting control, a printing control and an ejection control.

The host computer 35 includes a printer driver (not shown) and acquires a variety of printing parameters, such as a sheet size, a sheet type, and a layout, which are set by allowing a user to operate an input device 35*b* on a print setting screen displayed on a display device 35*a* on the basis of an instruction input by the user. The printer driver performs a predetermined process and generates printing data when receiving the printing instruction from the input device 35*b*. In more detail, the printer driver sequentially performs a resolution conversion process for converting image data to be printed from display resolution to print resolution, a color conversion process for converting an RGB color coordinate system into a CMYK color coordinate system, a halftone process for converting into a gradation value which can be expressed by the printer 11, and a rasterizing process (micro-weaving process) for rearranging data sequence (discharge sequence) to be transported to the printer 11. A command to be given to the obtained print image data is attached to a header to generate the printing data. The header includes a printing parameter including the sheet size or a parameter such as a target speed or a transporting distance (paper transporting amount or the like) at the time of transporting the sheet, which indicates contents instructed by the command, in addition to the command.

The CPU 43 receives the printing data from the printer driver of the host computer 35 through the interface 41 and the bus 42. The CPU 43 acquires the sheet length $P_{size}$ from the header of the printing data which is first received from the host computer 35. The CPU 43 analyzes the command included in the header of the printing data and acquires a variety of commands such as feed, transport and ejection of the sheet and the parameter which expresses the instructions by numerical values, such as the target speed and the transporting distance of the sheet at the time of feeding, transporting and ejecting the sheet.

The ASIC 44 receives the print image data excluding the header of the printing data from the CPU 43, performs an image process (image development process) on the print image data, and converts the print image data into bit map data having a predetermined gradation value used for generating a discharge signal for discharging an ink droplet from the nozzle of the recording head 19. The ASIC 44 sends the converted bit map data to a head driver 48. The head driver 48 controls the recording head 19 on the basis of the bit map data and discharges the ink droplet from the nozzle.

The CPU 43 is connected to motor drivers 49, 50, 51 and 52. The CPU 43 drives and controls a carriage motor 55, an ASF motor 56, a sub motor 57, and a PF motor 58 (paper transporting motor) through motor drivers 40 to 52. In more detail, the CPU 43 gives control data to the motor driver 50, and the motor driver 50 drives and controls the ASF motor 56 to be rotated in a rotation direction at a rotation speed based on the control data. The CPU 43 gives the control data to the motor driver 52, and motor driver 52 drives and controls the PF motor 58 to be rotated in a rotation direction at a rotation speed based on the control data. The other motor drivers 49 and 51 drive and control the carriage motor 55 and the sub motor 57 in the same method.

An output shaft of the PF motor 58 is connected to the transport driving roller 29*a* and the ejection driving roller 30*a* through a gear train (not shown) such that power can be delivered. A transporting device is configured by the motor driver 52, the PF motor 58 and the paper transporting roller 29.

The ASF motor 56 rotates the feeding roller 22. The sub motor 57 is connected to the retardation roller 24 and the hopper 15 to deliver power such that the retardation roller 24 and the hopper 15 are moved between the withdrawn position and the feeding position in interlock with each other.

The ASF motor 56 includes a rotary encoder for detecting the rotation of the output shaft thereof, and the PF motor 58 includes a rotary encoder for detecting the rotation of the output shaft thereof. The encoders 61 and 62 generate and output pulse signals having respective periods inversely proportional to rotation speeds of the respective motors corresponding thereto. The CPU 43 is connected to the paper detection sensor 33 and the encoders 61 and 62 as an input system and the CPU 43 receives an on/off signal of the paper detection sensor 33 and the pulse signals from the encoders 61 and 62.

The CPU 43 includes the paper transporting amount counter 65, the ASF counter 66 and the PF counter 67. The paper transporting amount counter 65 is reset by the CPU 43 when the paper detection sensor 33 is activated, and pulse edges of the pulse signal received from the encoder 62 are counted after the reset. Thereafter, when the paper transporting amount counter 65 counts a count value corresponding to the transporting amount of the sheet P1, the driving of the ASF motor 56 is stopped and the sheet P1 is fed (detected). After the feed of the sheet is finished, the count value of the paper transporting amount counter 65 is updated to a count value corresponding to a paper transporting amount in which the position of the sheet P when the front end of the sheet P1 reaches the head reference position H (uppermost nozzle) is set as an original point by subtracting a value corresponding to the distance (La+Lb) shown in FIG. 3 therefrom. Accordingly, the count value Nx of the paper transporting amount counter 65 after the feed of the sheet is finished becomes a value corresponding to the paper transporting amount when the front end of the sheet P1 reaches the head reference position H is set to "0". The CPU 43 checks the position (transport position) of the set sheet P from the count value Nx of the paper transporting amount counter 65.

The ASF counter 66 counts the pulse edges of the pulse signal received from the encoder 61 for detecting the rotation of the ASF motor 56. The ASF counter 66 is reset before the driving of the ASF motor 56 starts, and counts the count value corresponding to the feeding amount (transporting amount) of the sheet fed by the feeding roller 22 driven by the ASF motor 56. Accordingly, the CPU 43 can check a position at which the fed sheet is positioned in a section from a feed start position and a feed end position, from the count value of the ASF counter 66. The CPU 43 checks the transport distance of the sheet on a sheet feeding path, in which the feed start position is set to an original point, from the count value of the ASF counter 66, and controls the speed of the ASF motor 56 according to the transport distance.

The PF counter 67 counts the pulse edges of the pulse signal received from the encoder 62 for detecting the rotation of the PF motor 58. The PF counter 67 is reset before the driving of the PF motor 58 starts, and counts the count value corresponding to the feeding amount (transporting amount) of the sheet fed by the paper transporting roller 29 driven by the RF motor 58. Accordingly, the CPU 43 can check a position at which the fed sheet is positioned in a section from a paper transport start position and a paper transport end position, from the count value of the PF counter 67. The CPU 43 checks the distance of the sheet on a sheet feeding path, in which the feed start position is set to an original point, from the count value of the PF counter 67, and controls the speed of the PF motor 58 according to the distance. In more detail, the CPU 43 reads an acceleration/deceleration table (shown in FIG. 6) from the non-volatile memory 47 and controls the speeds of the ASF motor 56 and the PF motor 58 to become the speeds according to the distance from the transport start position according to the acceleration/deceleration table. In this specification, the driving of the ASF motor 56 is also denoted by "ASF driving" and the driving of the PF motor 58 is also denoted by "PF driving".

Figure 10:
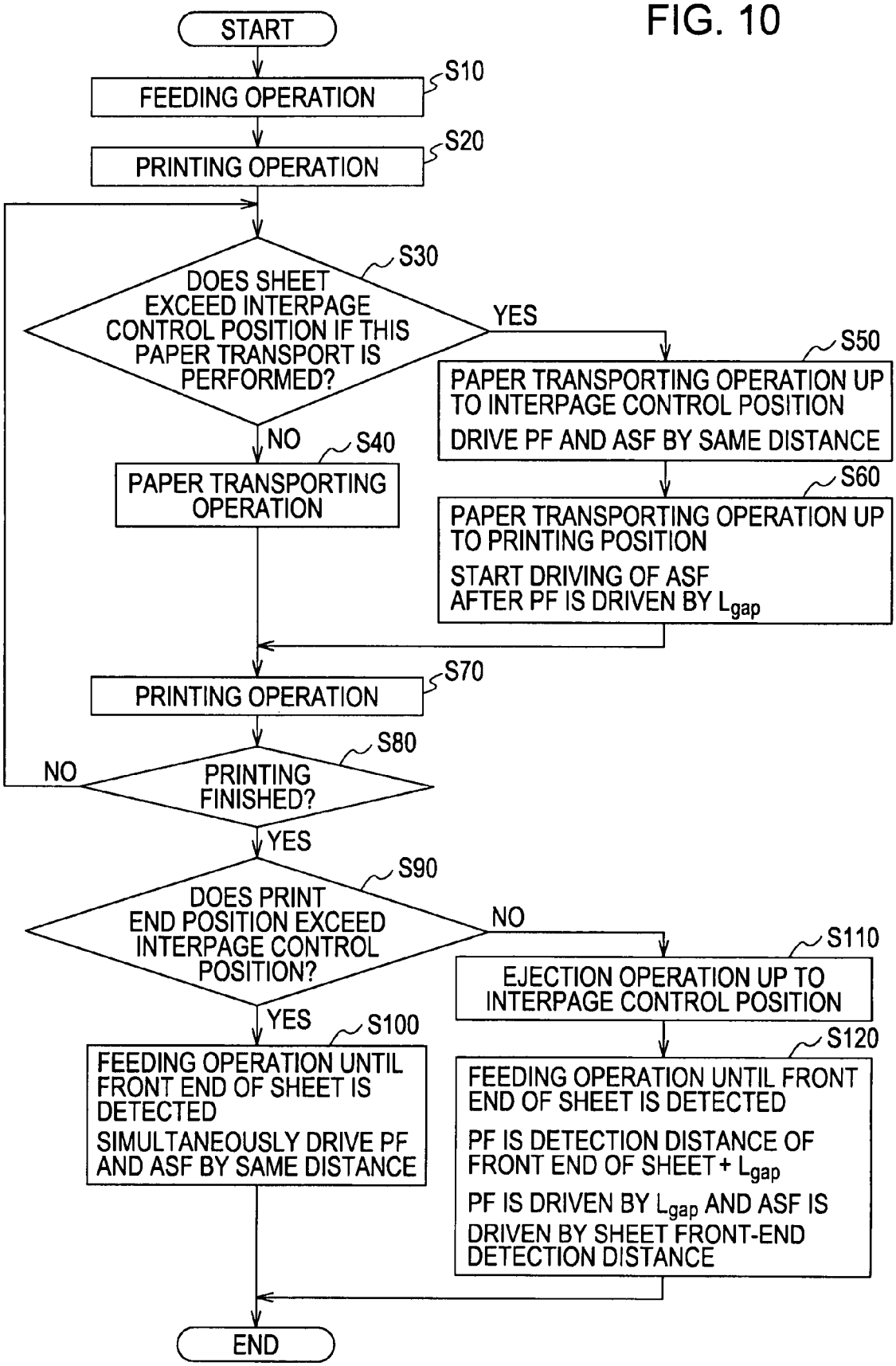
FIG. 10 is a flowchart showing a sheet transport control process.

In the printer 11 according to the present embodiment, the interpage control for ensuring a predetermined gap between the previous sheet and the next sheet is employed. In the ROM 45, an interpage control process routine program shown in the flowchart of FIG. 10 is stored. The CPU 43 executes this program and performs the interpage control such that the gap between the previous sheet and the next sheet is ensured.

Figure 4:
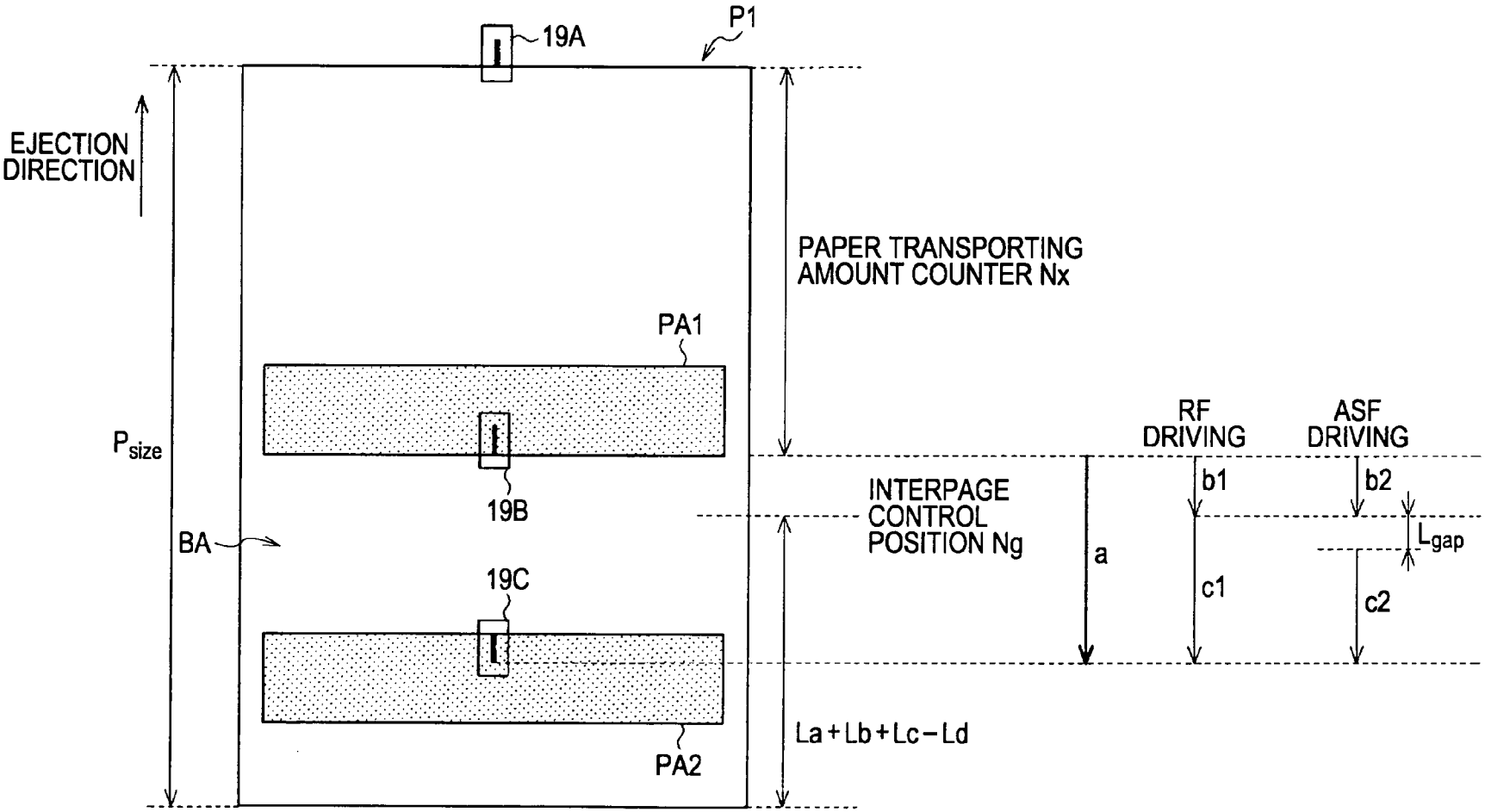
FIG. 4 is a schematic plan view illustrating transport of the sheet passing through an interpage control position.

FIG. 4 is a schematic view of a sheet for explaining the interpage control process executed at the time of the sheet transporting operation for passing through the interpage control position Ng. In FIG. 4, an upper direction denoted by an arrow is an ejection direction (paper transporting direction). The sheet is transported in the paper transporting direction by moving the sheet relative to the recording head 19 fixed to a predetermined position, but, in FIG. 4, the recording head 19 is moved relative to the sheet P1 assuming that a viewing point is moved together with the sheet P1. In FIG. 4, thick lines in the recording heads 19 (19*a* to 19*c*) indicate a nozzle array.

Printing is progressed one row by one row from the front end (upper end of FIG. 4) of the sheet P1, the sheet is transported by the paper transporting amount which is intermittently instructed whenever the printing of one line (one pass) is performed, and the printing is performed downward from the upper end. At this time, the recording head 19 is moved relative to the sheet P1 from the upper side to the lower side of FIG. 4 as the printing is progressed. For example, the position of the recording head 19A shown in FIG. 4 indicates the original position having the paper transporting amount of "0" in which the front end of the sheet is identical to the head reference position H (uppermost nozzle). The paper transporting amount from the original position of the sheet P1 is counted by the paper transporting amount counter 65 and the CPU 43 can checks the position of the sheet in the transporting direction (sub-scanning direction Y), from the count value of the paper transporting amount counter 65.

Shadowed areas of the sheet P1 shown in FIG. 4 indicate print areas PA1 and PA2 in which the recording head 19 performs the printing. As shown in FIG. 4, if a blank area BA in which the printing is not performed is present between the two print areas PA1 and PA2, the recording head 19B completing the printing of the print area PA1 is moved to the position of the recording head 19C which is the print start position of the print area PA2, by transporting the sheet by the transporting distance "a". When the sheet passes through the interpage control position Ng while the sheet is transported, the paper transporting operation of the transporting distance "a" is divided into the paper transporting operation of the transporting distance "b1" from the sheet position of the recording head 19B to the interpage control position Ng and the paper transporting operation of the transporting distance "c1" from the interpage control position Ng to the sheet position of the recording head 19C. That is, the PF driving is divided into the two paper transporting operations of the transporting distance "b1" and the transporting distance "c1".

At this time, the ASF driving is divided into the feeding operation of the transporting distance "b2" up to the interpage control position Ng and the feeding operation of the transporting distance "c2" while the PF driving is performed. In the PF driving of the transporting distance "b1" and the ASF driving of the transporting distance "b2", the transporting distance "b1" and "b2" are identical and the sheet transporting speeds are identical. This is because the sheet P1 is nipped by the feeding roller 22 and the paper transporting roller 29 at the time of transporting the sheet before reaching the interpage control position Ng and thus the feeding roller 22 and the paper transporting roller 29 need to be simultaneously driven. If the feeding roller 22 and the paper transporting roller 29 are not simultaneously driven, looseness occurs or excessive tension occurs such that the sheet is not suitable transported. Accordingly, the ASF driving and the PF driving are performed such that the transporting distances "b1" and "b2" are identical and the sheet P1 is transported at the same transporting speed.

When the PF driving of the transporting distance "b1" is finished, the PF driving of the transporting distance "c1" is continuously performed. Meanwhile, with respect to the ASF driving, the ASF driving starts at a time point when the sheet P1 is transported by the distance $L_{gap}$ by the PF driving, which starts the paper transporting operation of the transporting distance "c1", after the feeding operation of the transporting distance "b2" is finished. That is, since the ASF driving starts later than the PF driving, the distance $L_{gap}$ is ensured between the previous sheet P1 transported by the PF driving and the next sheet P2 fed by the ASF driving. Since acceleration starts late by the ASF driving, the gap between the previous sheet P1 and the next sheet P2 may temporarily become larger than the distance $L_{gap}$ at the time of transporting the sheet, the gap after the transport is finished becomes the distance $L_{gap}$ by transporting the sheet by a predetermined transporting distance.

Thereafter, since the ASF driving and the PF driving are performed such that the sheet is transported by the same transporting distance, the transport of the previous sheet P1 and the feed of the next sheet P2 are continuously performed with the gap corresponding to distance $L_{gap}$ therebetween. In FIG. 4, the interpage control position Ng is opposed to the head reference position H of the sheet when the rear end (lower end of FIG. 4) of the sheet is positioned at the interpage control position G of FIG. 3 and becomes the position of the distance (La+Lb+Lc−Ld) from the rear end of the sheet in the sheet transporting direction.

Figures 6, 7:
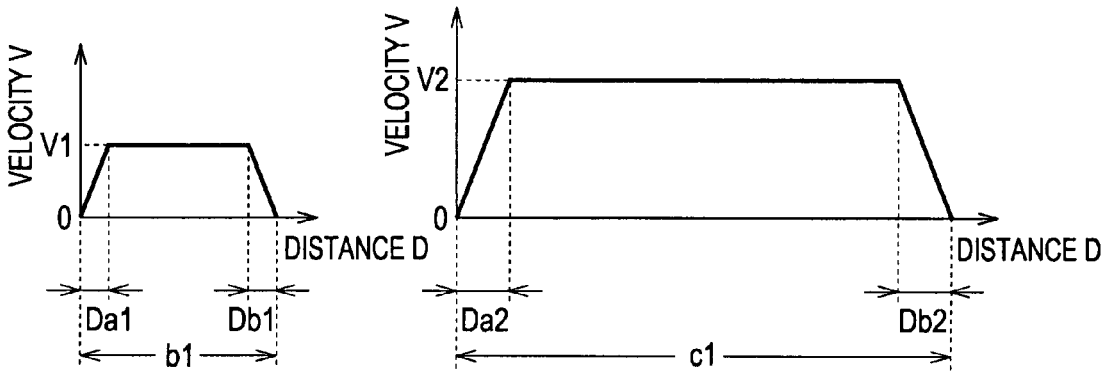
FIG. 6 is a view showing an acceleration/deceleration table.
FIG. 7 is a graph showing a speed waveform of the acceleration/deceleration table.

FIG. 6 shows the acceleration/deceleration table which is referred when controlling the speeds of the ASF motor and the PF motor. In the ROM 45, data of the acceleration/deceleration table for determining the speed profiles of the ASF motor 56 and the PF motor 58 is stored. Among them, FIG. 6 shows only the acceleration/deceleration table for the PF motor. The acceleration/deceleration table of the present embodiment is prepared for each target speed. FIG. 6 shows an acceleration/deceleration table VT1 of a target speed V1 and an acceleration/deceleration table VT2 of a target speed V2 (V1<V2). Since the basic configurations of the tables are identical except that the target speeds are different, for example, the acceleration/deceleration table VT1 will be described herein. The acceleration/deceleration table VT1 includes an acceleration table VTa1 for determining an acceleration profile and a deceleration table VTb1 for determining a deceleration profile and is configured by a table indicating correspondence between distances D and periods T. Here, the periods T are pulse edge periods of the encoders 61 and 62. The distances D and the periods T are set in correspondence with each other.

The CPU 43 previously resets the ASF counter 66 and the PF counter 67 before the driving of the ASF motor 56 and the PF motor 58 starts (the transport of the sheet starts). The CPU 43 acquires the count value of the PF counter 67 obtained by the counting the pulse edges having a period inversely proportional to the motor rotation speed received from the encoder 62, for example, at the time of transporting the sheet as the distance D (motor driving amount) from the motor rotation start position (sheet transport start position). The CPU 43 controls the speed of the PF motor 58 by giving the period T corresponding to the distance D to the motor driver 52 by referring to the selected acceleration/deceleration table VT.

The CPU 43 acquires the count value of the ASF counter 66 obtained by the counting the pulse edges received from the encoder 61 as the distance D from the motor rotation start position, with respect to the ASF motor 56. The CPU 43 controls the speed of the ASF motor 56 by giving the period T corresponding to the distance D to the motor driver 51 by referring to the selected acceleration/deceleration table VT. The period of the pulse edges acquired from the encoders 61 and 62 may be counted to perform a feedback control such that the counted detection period is identical to the target period T.

The target speeds V1 and V2 which are constant speed ranges are determined by shortest periods T1 and T2 (target periods) of a data group of the acceleration table. The values corresponding to the distance D and the period T are identical in the two acceleration/deceleration tables VT1 and VT2 in FIG. 6, but the values for obtaining suitable acceleration/deceleration profiles according to the target speeds V1 and V2 are actually set. Although not shown, the acceleration/deceleration table for the ASF motor basically the same configuration. The acceleration/deceleration table VT for the ASF motor is prepared so as to obtain the acceleration/deceleration profile which preferentially allows the sheet to be fed to the detection position with certainty, but the acceleration/deceleration table for the PF motor is prepared so as to preferentially obtain the acceleration/deceleration profile which stop position precision of the sheet at the time of the paper transporting operation is preferential. The acceleration/deceleration profiled may be suitably changed according to the design spirit.

Since the target value (period T) is determined according to the distance D in the acceleration/deceleration range on the basis of the acceleration/deceleration tables VT1 and VT2, the CPU 43 outputs the voltage command value and the target value according to the distance D to the motor drivers 50 and 52. The motor drivers 50 and 52 respectively control the speeds of the ASF motor 56 and the PF motor 58 corresponding to the input target values. The motor drivers 50 and 52 control the voltages applied to the ASF motor 56 and the PF motor 58 corresponding to the received voltage command values. The values of current flowing in the ASF motor 56 and the PF motor 58 are determined by this voltages such that rotation torques according to the current values are obtained. The voltage command values are determined using a separate table in each distance D or each of a plurality of speed ranges of the acceleration/deceleration range. A method of obtaining a deceleration start position which is a start point of the distance D in the deceleration table will be described later.

FIG. 7 shows a speed waveform of a speed profile obtained by the speed control based on the acceleration/deceleration table. In the graphs showing the speed waveform, a horizontal axis indicates the distance D and a vertical axis indicates the speed V. In FIG. 7, a left graph corresponds to the acceleration/deceleration table VT1 of FIG. 6 and a right graph corresponds to the acceleration/deceleration table VT2 of FIG. 6. Here, the speed V is a value corresponding to an inverse number of the period T. The transporting distances (b1 and c1 in the graphs of FIG. 7) of the sheet are acquired from a transporting distance parameter (e.g., "Dy") indicating numerical data of the transporting distance given together with a paper transporting command, a feeding command and an ejection command in the header of printing data. The two graphs shown in FIG. 7 respectively show an example in which the transporting distance Dy is Dy=b1 and an example in which the transporting distance Dy is Dy=c1.

As shown in FIG. 7, the speed waveform based on the acceleration/deceleration table VT has substantially a trapezoidal shape, but the height of the trapezoidal waveform is proportional to the target speed. As the height of the trapezoidal waveform is increased, a movement distance Da (Da1 and Da2 in the graphs of FIG. 2) necessary for acceleration and a movement distance Db (Db1 and Db2 in the graphs of FIG. 7) necessary for deceleration are increased. Accordingly, in order to reach the target speed Vc (V1 and V2 in the graphs of FIG. 7) (or the target period Tc), the sum (Da+Db) of the movement distance Da of the acceleration range from an acceleration start point (distance D=0) to the target speed Vc or the target period Tc) and the movement distance Db of the deceleration range from the target speed Vc (or the target period Tc) to the stop is required as a minimum distance. Accordingly, if the transporting distance Dy (=b1, c1) is determined, the transporting distance Dy equal to or larger than the minimum distance (Da+Db) becomes the condition of the employable acceleration table VT.

The CPU 43 executes a feeding sequence when receiving a feeding command from the header of the printing data, executes a paper transporting sequence when receiving a paper transporting command, and executes an ejection sequence when receiving an ejection command. The CPU 43 acquires the target speed and the transporting distance Dy as parameters indicating the detailed execution contents when the command is executed, together with the command, when acquiring the feeding command, the paper transporting command and the ejection command. The target speed (hereinafter, referred to as a first target speed) indicated by the parameter of the command is set according to a printing mode and each of the feeding operation, the paper transporting operation and the ejection operation. The printing mode includes a high-speed printing mode which gives preference to a printing speed over printing quality or an image-quality preference mode which gives preference to the printing quality over the printing speed.

The selection of the acceleration/deceleration table VT is as follows. First, the acceleration/deceleration table VT having the first target speed given as the parameter of the command as the target speed is examined, the minimum distance (Da+Db) and this transporting distance Dy are compared, and the acceleration/deceleration table VT for the first target speed is employed if "Dy" is equal to or larger than the minimum distance (Da+Db). In contrast, if "Dy" is smaller than the minimum distance (Da+Db), the acceleration/deceleration table for the first target speed cannot be employed by the relationship of the minimum distance. Thus, a table having a highest target speed (second target speed) is selected from the other acceleration/deceleration tables satisfying the condition that the transporting distance Dy is equal to or larger than the minimum distance (Da+Db).

If the transporting distance Dy and the acceleration/deceleration table VT are determined, the CPU 43 starts a motor speed control. For example, the control of the speed of the PF motor 58 will be described with reference to the acceleration/deceleration table VT1 of the target speed V1 shown at the left side of FIG. 6 and the left graph of FIG. 7. The CPU 43 first resets the PF counter 67 and sequentially gives the period Ts corresponding to the distances D which is the count value of the PF counter 67 to the motor driver 52 by referring to the acceleration table VTa1 of the selected acceleration/deceleration table VT1 to accelerate the PF motor 58. If the distance D reaches such that the given period T becomes the target period T, the acceleration is finished and the target period T1 is continuously given in the constant speed range. When reaching a deceleration start position (position of the distance "Dy−Db1"), the periods T according to the distances D from the deceleration start position are sequentially given by referring to the deceleration table VTb1 to decelerate the PF motor 58.

However, the transporting speed of the feeding roller 22 is determined by a deceleration ratio of the gear train between the ASF motor 56 and the feeding roller 11 and an outer diameter of the feeding roller 22. The transporting speed of the paper transporting roller 2 is determined by a deceleration ratio of the gear train between the PF motor 58 and the transport driving roller 29*a* and an outer diameter of the transport driving roller 2*a*. In the embodiment, if the rotation speed of the ASF motor 56 and the rotation speed of the PF motor 58 are equal, the deceleration ratios of the both gear trains and the diameters of the rollers are set such that the transporting speed of the feeding roller 22 and the transporting speed of the paper transporting roller 2 become equal. Accordingly, the speed V of the graph of FIG. 7 and the graphs of FIGS. 8 and 9 indicates the transporting speed of the sheet at the time of the ASF driving and the PF driving, and may indicate the rotation speeds of the ASF motor 56 and the PF motor 58 having the same conversion rate with respect to the transporting speed.

Next, a sheet transporting process routine executed by the CPU 43 shown in the flowchart of FIG. 10 will be described with reference to the graphs of FIGS. 7 and 9.

In a step S10, the feeding operation is performed. That is, the ASF motor 56 and the PF motor 58 are driven in a state in which the hopper 15 and the retardation roller 24 are positioned at the feeding position shown in FIG. 1B by the driving of the sub motor 57 such that the sheet P is fed. The front end of the sheet P1 is detected by this feeding operation. At this time, when a position where the front end of the sheet P1 is equal to the head reference position H (see FIG. 3) is set to an original point, the paper transporting amount counter 65 counts the count value corresponding to the paper transporting amount from the original point.

In a step S20, a printing operation is performed. That is, the carriage motor 55 is driven so as to move the carriage 18 in the main scanning direction X and ink is discharged from the nozzles of the recording head 19 at a printing position, thereby performing printing of one pass.

In a step S30, it is determined whether the sheet exceeds the interpage control position Ng when this paper transport is performed. In more detail, it is determined whether a value obtained by adding the transporting distance Dy to the current count value Nx of the paper transporting amount counter 65 exceeds the interpage control position Ng. If the value exceeds the interpage control position Ng, the process progresses to a step S50, and, if the value does not exceed the interpage control position Ng, the process progresses a step S40. When the current position Nx of the previous sheet P1 is identical to the interpage control position Ng, the value (Nx+Dy) obtained by adding the transporting distance Dy to the count value Nx is larger than the interpage control position Ng. Thus, since the sheet first exceeds the interpage control position Ng by this paper transport, it is determined that the sheet exceeds the interpage control position Ng.

In the step S40, the paper transporting operation is performed. That is, the ASF motor 56 and the PF motor 58 are driven by the paper transporting command such that the sheet is transported by the transporting distance Dy.

In contrast, if it is determined that the sheet exceeds the interpage control page Ng by this paper transport in the step S30, the following steps S50 and S60 are performed and a predetermined gap $L_{gap}$ is ensured between the previous sheet and the next sheet.

In the step S50, the paper transporting operation is performed up to the interpage control position. That is, if it is determined that the sheet exceeds the interpage control position Ng by this paper transport in the step S30, this paper transporting operation is divided into a first paper transporting operation for transporting the sheet from a paper transport start position (current position Nx) to the interpage control position Ng and a second paper transporting operation for transporting the sheet from the interpage control position Ng to a paper transport end position (Nx+Dy). The first paper transporting operation is performed in this step. In the first paper transporting operation, the ASF motor 56 and the PF motor 58 are driven at the same speed by the same distance. That is, the feeding roller 22 and the paper transporting roller 29 transport the sheet by the same distance at the same transporting speed.

At this time, the transporting distance of the first paper transporting operation is determined by "Ng−Nx". If the transporting distance (Ng−Nx) is equal to or larger than the minimum distance (Da+Db) of the acceleration/deceleration table VT for the first target speed, the acceleration/deceleration table VT for the first target speed is employed. If the condition of the minimum distance is not satisfied, an acceleration/deceleration table having a highest target speed is selected from the other acceleration/deceleration tables VT satisfying the condition that the transporting distance (Ng-Nx) is equal to or larger than the minimum distance (Da+Db). The selection of the acceleration/deceleration table VT is performed with respect to the ASF motor 56 and the PF motor 58 such that the acceleration/deceleration tables VT which are respectively employed by the ASF motor 56 and the PF motor are selected. If the target speeds of the selected acceleration/deceleration table VT are different, the acceleration/deceleration table VT having a high target speed is changed to the acceleration/deceleration table VT having a low target speed. Accordingly, the acceleration/deceleration tables having the same target speed are determined with respect to the ASF motor 56 and the PF motor 58.

If a ratio of the rotation speed of the ASF motor 56 to the transporting speed of the feeding roller 22 and a ratio of the rotation speed of the PF motor 58 to the transporting speed of the paper transporting roller 29 are different in the deceleration rate in which the gear train between the ASF motor 56 and the feeding roller 22 and the gear train between the PF motor 58 and the paper transporting roller 29, the acceleration/deceleration tables VT for the ASF motor 56 and the PF motor 58 are determined such that the transporting speeds of the feeding roller 22 and the paper transporting roller 29 become equal. If the current position Nx of the previous sheet P1 is identical to the interpage control position Ng, since the transporting speed of the first paper transporting operation "0", the first paper transporting operation of the step S50 is not performed and only the second paper transporting operation of the step S60 is performed.

In the step S60, the paper transporting operation is performed up to the printing position. That is, the second paper transporting operation is performed. In this paper transporting operation, first, the driving of the PF motor 58 starts, the PF motor 58 is driven by the interpage control distance $L_{gap}$, and the driving of the ASF motor 56 starts. A driving start timing of the ASF motor 56 is determined by a time point when the count value of the PF counter 67 reset at the time of starting the driving of the PF motor 58 reaches the interpage control distance $L_{gap}$. In the present embodiment, if the count value of the PF counter 67 which is the position parameter for measuring the driving position of the PF motor 58, which is first driven, of the ASF motor 56 and the PF motor 58 reaches a predetermined value (standby end position), a control for allowing the driving of the standby ASF motor 56 is performed. The predetermined gap $L_{gap}$ is ensured between the previous sheet and the next sheet by the motor control.

In a step S70, the printing operation is performed. This printing operation is equal to the step S20.

In a step S80, it is determined whether printing is finished. When the ejection command of the printing data is received, it is determined that the printing is finished. If the printing is finished, the process progresses to a step S90 and, if the printing is not finished, the process progresses to the step S30. That is, the processes from the step S30 to S80 are repeated until it is determined that the printing is finished in the step S80. When the paper transporting operation S40 and the printing operation S70 are alternately performed and it is determined that the count value Nx of the paper transporting amount counter 65 exceeds the interpage control position Ng by this paper transport, the interpage control steps S50 and S60 are performed. If it is determined that the printing is finished in the step S80, the process progresses to a step 90.

In the step S90, it is determined whether a print end position exceeds the interpage control position. The print end position indicates the count value Nx of the paper transporting amount counter 65 which receives the ejection command. If the print end position exceeds the interpage control position Ng, the process progresses to a step S100 and, if the print end position does not exceed the interpage control position Ng, the process progresses to a step S110.

In the step S100, the feeding operation is performed up to the detection of the front end of the sheet. That is, in this feeding operation, the PF motor 58 and the ASF motor 56 are simultaneously driven by the same distance up to the position where the front end of the next sheet is detected by the paper detection sensor 33.

If it is determined that the print end position does not exceed the interpage control position Ng in the step S90, the following steps S110 and S120 are performed such that the predetermined gap $L_{gap}$ is ensured between the previous sheet and the next sheet.

In the step S110, the ejection operation is performed up to the interpage control position. That is, if it is determined that the print end position does not exceed the interpage control position Ng in the step S0, the interpage control for ensuring the predetermined gap between the previous sheet and the next sheet during the sheet ejection needs to be performed. Accordingly, the sheet P1 is ejected up to the interpage control position shown in FIG. 3, in which the count value of the paper transporting amount counter 65 becomes Ng.

In the step S120, the feeding operation is performed until the front end of the sheet is detected. That is, the feeding operation for feeding the next sheet up to the position where the front end of the next sheet is detected by the paper detection sensor 33 is performed after the previous sheet is ejected to the interpage control position Ng. In this feeding operation, the PF motor 58 is driven by a distance ($Lc-Ld+L_{gap}$) obtained by adding the interpage control distance $L_{gap}$ to the sheet front-end detection distance (Lc−Ld) necessary for transporting the next sheet from the position shown in FIG. 3 to the detection position of the paper detection sensor 33, and the ASF motor 56 is driven by the sheet front-end detection distance (Lc−Ld) after the PF motor 58 is driven by the interpage control distance $L_{gap}$.

When the program of the sheet transporting control process is finished, the next sheet is fed up to a position where the front end of the next sheet is detected by the paper detection sensor 33 and the previous sheet is ejected such that the predetermined gap $L_{gap}$ is ensured between the rear end of the previous sheet and the front end of the next sheet. Thereafter, the program is executed again such that the detection of the front end of the next sheet starts.

In the steps S50 and S110, the process of transporting the previous sheet P1 up to the interpage control position Ng by the ASF driving and the PF driving corresponds to a transporting step and the process of stopping the ASF driving corresponds to a feed stop step. In the steps S60 and S120, the process of resuming the ASF driving after the gap between the sheets P1 and P2 reaches the interpage control distance $L_{gap}$ corresponds to the feed resuming step. In the steps S50 and S110, the process of giving pause to the PF driving when the previous sheet P1 reaches the interpage control position Ng corresponds to a transport pause step.

Next, the operation of the printer 11 for performing the sheet transporting process according to the interpage control will be described.

When printing is performed, there are three cases where the sheet passes through the interpage control position Ng. A first case is a case where the printing is substantially performed with respect to the entire surface of the sheet, that is, a case where the sheet passes through the interpage control position Ng at the time of transporting the sheet while a paper transporting operation of a minimum transport pitch and a printing operation of one pass are alternately performed. In this case, the paper transporting operation is divided into two transporting operations, the previous sheet is transported by the two paper transporting operations, and the next sheet is transported in only the first sheet transporting operation. Thereafter, the previous sheet is transported by the minimum transport pitch together with the printing operation, but the driving of the ASF motor 56 is not permitted until the count value of the paper transporting amount counter 65 reaches the value ($Ng+L_{gap}$). Then, when the predetermined distance $L_{gap}$ is ensured between the previous sheet and the next sheet, the driving of the ASF motor 56 is permitted and the ASF motor 56 and the PF motor 58 are driven by the same distance at the time of transporting the sheet.

A second case is a case where the blank area BA is present between the two printing areas PA1 and PA2 and the sheet passes through the interpage control position Ng during the sheet transport of the transporting distance "a" from the position where the printing of the printing area PA1 is finished to the print start position of the printing area PA2, as shown in FIG. 4. In this case, when the sheet transport of the transporting distance "a" is performed, it is determined that the sheet passes through the interpage control position Ng (Yes, in the step S30). That is, it is determined that the paper transporting amount count value (Nx+a) obtained by adding the transporting distance "a" to the current count value Nx of the paper transporting amount counter 65 exceeds the interpage control position Ng (Nx+a>Ng). The paper transport of the transporting distance "a" is divided into two PF driving operations of the transporting distance b1 and the transporting distance c1 and is divided into two ASD driving operations of the transporting distance b2 and the transporting distance c2. First, the PF driving of the transporting distance b1 and the ASF driving of the transporting distance b2 (=b1) are substantially simultaneously performed such that the sheet is transported to the interpage control position Ng. Subsequently, the PF driving of the transporting distance c1 is performed and the ASF driving is permitted when the previous sheet is driven by the distance $L_{gap}$. Thus, the ASD driving of the transporting distance c2 starts. Accordingly, the gap corresponding to the distance $L_{gap}$ is ensured between the previous sheet and the next sheet.

A third case is a case where printing is performed in only the area in the vicinity of the front end of the sheet P1 and the sheet passes through the interpage control position Ng during the ejection after the printing is finished. When the printing is finished, the previous sheet P1 is nipped by the feeding roller 22. In this case, the ejection operation due to the ASF driving and the PF driving of the transporting distance ($P_{size}$−La−Lb−Lc−Nx) which is necessary until the previous sheet reaches the interpage control position Ng is performed, and the ASF driving of the transporting distance (Lc−Ld) necessary for transporting the sheet from the position where the previous sheet reaches the interpage control position Ng to the position where the next sheet is detected by the paper detection sensor 33 and the feeding operation due to the PF driving of the transporting distance ($Lc-Ld+L_{gap}$) are performed. In the latter feeding operation, the ASF driving is permitted after the PF driving is performed by the predetermined gap $L_{gap}$.

In the present embodiment, in either of the three cases, at the time of the sheet transport which passes through the interpage control position Ng, since the ASF driving is permitted after the sheet transport up to the interpage control position Ng and the PF driving of the interpage control distance $L_{gap}$, the gap corresponding to the distance $L_{gap}$ is ensured. Among the three cases, in the second case of the sheet transport over the blank area BA and the third case of the ejection operation, the transporting distance becomes long before division into two transporting operations. In this case, the previous transporting distance b1 and the next transporting distance c1 are generally different according to a position where one transporting operation is divided. When one transporting operation is divided into two transporting operations, the divided two transporting distance becomes short. Accordingly, due to the relationship of the minimum distance, there is a case where the transporting speed of the transporting operation having a small transporting distance and the transporting speed of the transporting operation having a large transporting distance are different.

With respect to the ASF driving, since the feeding stands by in order to ensure the distance $L_{gap}$, the ASF driving needs to pause, but the PF driving does not need to pause. When the paper transporting operation or the ejection operation is performed by one transporting operation, throughput is efficient. However, when the PF driving is not stopped, the change of the speed is required when the previous transporting speed and the next transporting speed are different. Accordingly, an acceleration/deceleration table for changing the speed should be prepared. Thus, in the present embodiment, the configuration in which the PF driving pauses is employed.

Figure 8:
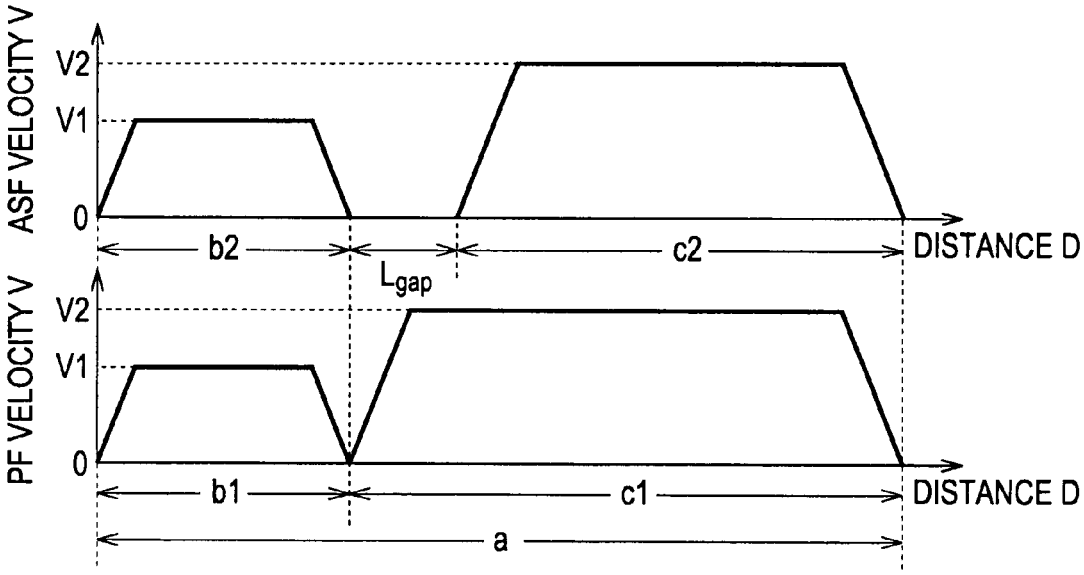
FIG. 8 is a graph showing a speed waveform.
Figure 9:
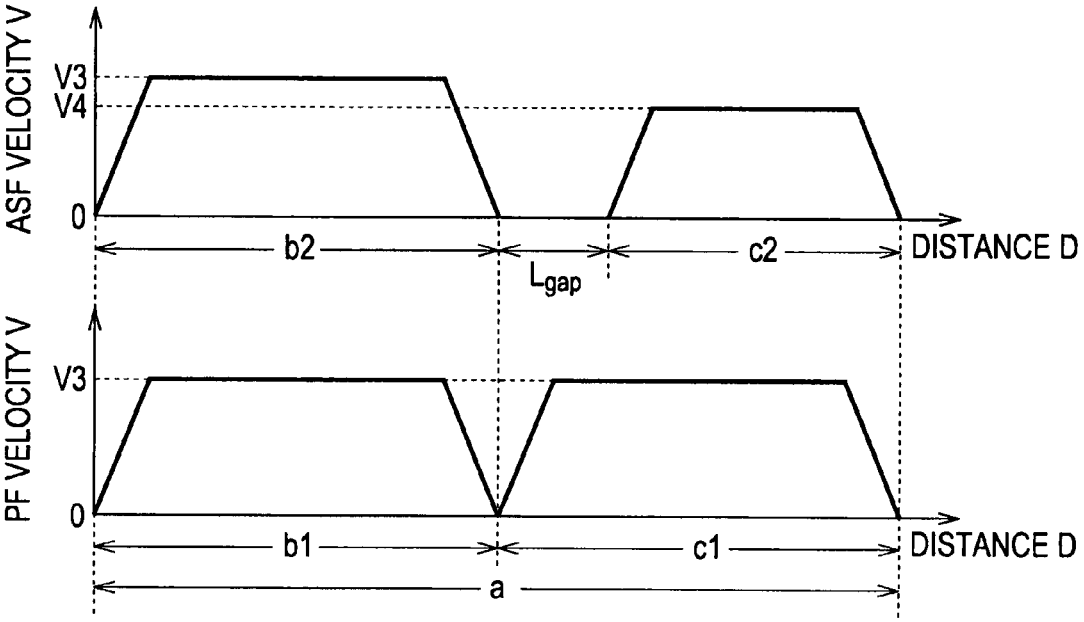
FIG. 9 is a graph showing a speed waveform.

FIGS. 8 and 9 show graphs explaining the interpage control. FIG. 8 shows a case where the transporting distances are different by the two transporting operations divided at the interpage control position Ng, and more particular, a case where the previous transporting distance is larger than the next transporting distance. FIG. 9 shows a case where the transporting distances are identical by the two transporting operation divided at the interpage control position Ng. These graphs show examples of transporting the sheet over the blank BA shown in FIG. 4. In FIGS. 8 and 9, an upper graph indicates the ASF driving and a lower graph indicates the PF driving. In these graphs, a horizontal axis indicates the distance D and a vertical axis indicates the speed V (the inverse number of the period T).

First, in a case where the transporting distance "a" is divided into two distances at the interpage control position Ng and the previous transporting distance b1 is larger than the next transporting distance c1, the interpage control will be described with reference to the graph of FIG. 8. The sheet can be transported by the transporting distance "a" at once through the PF driving, but the ASF driving and the PF driving are performed at the same speed at the time of the transport up to the interpage control position Ng where the previous sheet is nipped by the feeding roller 22 and the paper transporting roller 2, in order to prevent excessive tension or excessive looseness from being given to a portion of the previous sheet nipped by the feeding roller 22 and the paper transporting roller 29. Meanwhile, as the acceleration/deceleration table VT of the ASF driving, a table having a highest target speed is selected from the acceleration/deceleration tables VT having a minimum distance of less than the transporting distance b2. Since the transporting distance b1 is originally small, the acceleration/deceleration table VT1 having a low target speed V1 is selected. Accordingly, in order to transport the sheet by the transporting distance "a" through the PF driving, the PF driving needs to be performed at the low target speed V1 over the entire range of the transporting distance "a" in accordance with the ASF driving of the transporting distance b2. In this case, since the PF driving is performed at the low speed by the transporting distance "a", throughput deteriorates. The deterioration of the throughput becomes more severe as the transporting distance "a" is increased. A configuration in which the speed is changed from the speed V1 to the speed V2 after passing through the interpage control position Ng may be considered, but, in this case, the acceleration/deceleration table for changing the speed is required.

In the present embodiment, the PF driving pauses when the ASF driving pauses at the interpage control position Ng. That is, as shown by the graph of FIG. 8, until the sheet reaches the interpage control position Ng, the ASF driving is performed by the transporting distance b2 at the speed V1 and the PF driving is performed by the transporting distance b1 (=b2) at the speed V1. That is, the ASF motor 56 and the PF motor 58 are driven at the same speed V1 by the same distance b2 (=b1). After the driving of the PF motor 58 pauses, the driving is resumed and is performed by the transporting distance c1. At this time, since the transporting distance c1 is sufficiently larger than the transporting distance b1, the acceleration/deceleration table VT2 having the high target speed V2(>V1) is selected and the sheet is transported at the speed V2. In this case, the deterioration of the throughput is more easily suppressed as the transporting distance c1 is larger than the transporting distance b1.

Subsequently, as shown by the graph of FIG. 9, if the transporting distance b1 is identical to the transporting distance b2, the speeds of the PF motor 58 when the sheet is transported by the transporting distances b1 and c2 become speed V3. In the present embodiment, even when the motor is driven at the same speed V3 before and after the interpage control position Ng, the driving of the PF motor 58 pauses when the driving of the ASF motor 56 pauses. The driving of the PF motor 58 pauses without exception when the driving of the ASF motor 56 pauses at the interpage control position Ng such that a process of determining whether the motor pauses or not is not added.

As described above in detail, according to the first embodiment, the following effects are obtained.

(1) In the sheet transport which passes through the interpage control position Ng, the ASF motor 56 and the PF motor 58 are driven at the same speed up to the interpage control position Ng, and, when the sheet is transported from the interpage control position Ng by the residual transporting distance, the start of the driving of the ASF motor 56 is permitted after the PF motor 58 is driven by the distance $L_{gap}$. Even when the previous sheet and the next sheet are continuously fed, it is possible to ensure the predetermined gap between the previous sheet and the next sheet. Accordingly, the front end of the next sheet can be detected by the paper detection sensor 33 with certainty.

(2) In a configuration in which the transporting speed depends on the transporting distance, the driving of PF motor 58 pauses when the ASF motor 56 pauses at the interpage control position Ng. Accordingly, when the transporting distance up to the interpage control position Ng is larger than the residual transporting distance from the interpage control position Ng, the driving speed V2 of the PF motor 58 is set to be higher than the driving speed V1 of the PF motor 58 such that the deterioration of the throughput can be suppressed.

(3) When the transporting distance is small due to the relationship of the minimum distance of the acceleration/deceleration table VT, the driving speed of the ASF motor 56 cannot be suppressed to a low speed. Even when the driving speed of the PF motor 58 cannot be adjusted to a low speed in accordance with the driving speed of the ASF motor 56, after passing through the interpage control position Ng, the transporting speed when the sheet is transported by the residual transporting distance c1 can be adjusted to a high speed, rather than the transporting speed when the sheet is transported by the transporting distance b1.

(4) When the ASF motor 56 is stopped at the interpage control position Ng, the driving of the PF motor pauses. Accordingly, after passing through the interpage control position Ng, it is possible to adjust the transporting speed to a high speed using the acceleration/deceleration table Vt, without adding the acceleration/deceleration table for changing the speed.

(5) When the ASF motor 56 is stopped at the interpage control position Ng, the driving of the PF motor 58 pauses without exception. Accordingly, it is possible to simplify the control contents without adding a determining process of determining whether the driving of the PF motor 58 pauses or not.

Second Embodiment

Next, a paper gap generating process according to a second embodiment will be described with reference to FIGS. 11 to 14. The second embodiment shows a configuration in which the ASF driving speed is increased from the position where the sheet passes through the interpage control position Ng, without giving pause to the PF driving when the ASF driving pauses. The configuration and the electrical configuration of the printer 11 are equal to those of the first embodiment and thus the same configuration as the first embodiment will be omitted. In particular, different interpage control will be described in detail.

Figure 14:
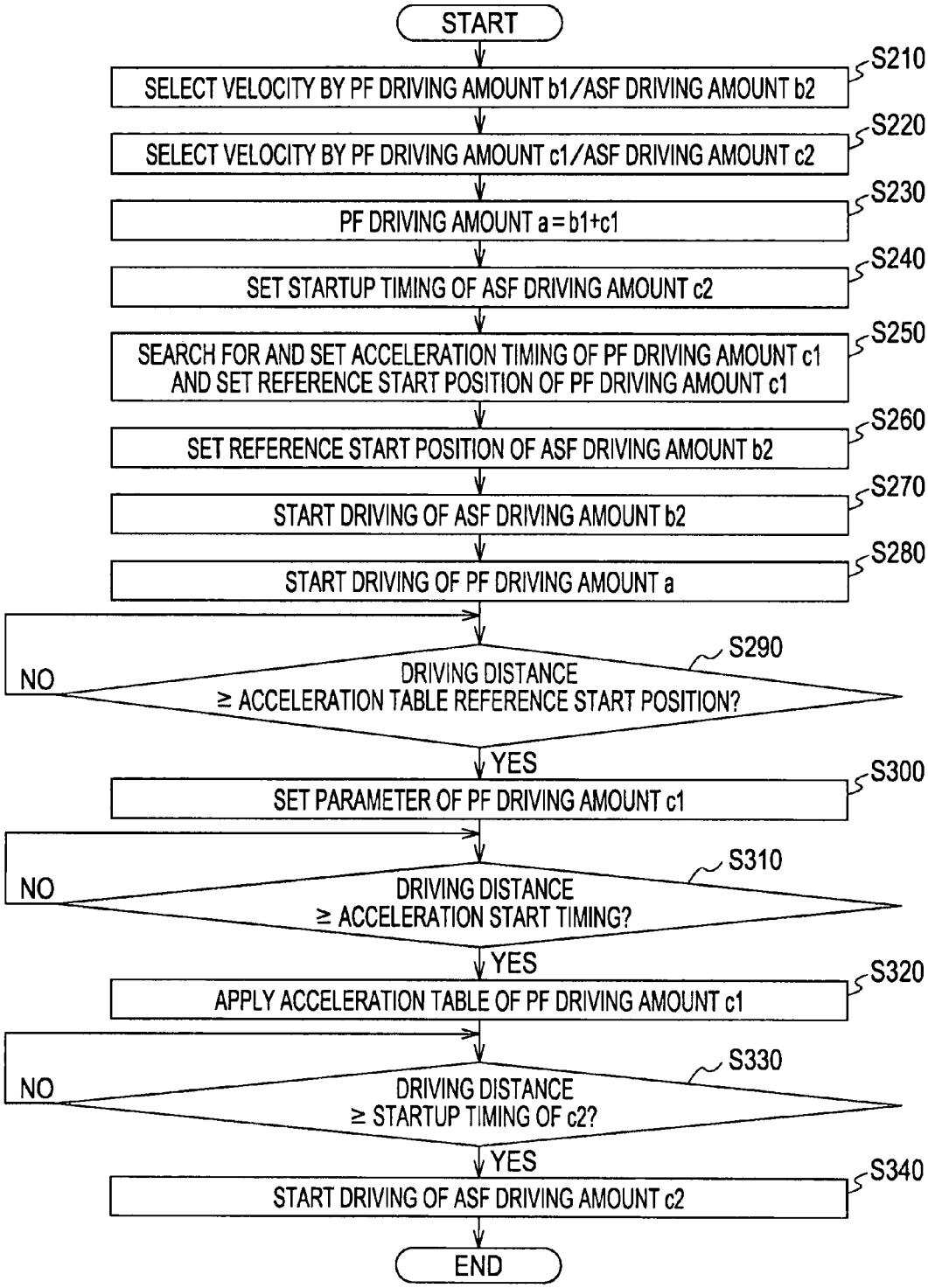
FIG. 14 is a flowchart showing an interpage control process.

The CPU 43 performs a sheet transporting control process shown in FIG. 10 described in the first embodiment. In the sheet transporting control process, if Yes in the step S30 and No in the step S90, when the interpage control is performed, instead of the steps S50 and S60 and the steps S110 and S120 of the first embodiment, the interpage control process shown in FIG. 14. In the flowchart of FIG. 14, the drivings of the PF motor 58 when the sheet is transported by the transporting distances b1 and c1 are denoted by "PF driving b1" and "PF driving c1" and the drivings of the ASF motor 56 when the sheet is transported by the transporting distances b2 and c2 are denoted by "ASF driving b2" and "ASF driving c2". The driving amounts of the ASF motor 56 necessary for transporting the sheet by the transporting distances b2 and c2 are denoted by "ASF driving amount b2" and "ASF driving amount c2", and the driving amounts of the PF motor 58 necessary for transporting the sheet by the transporting distances b1 and c1 are denoted by "PF driving amount b1" and "PF driving amount c1".

Figure 11:
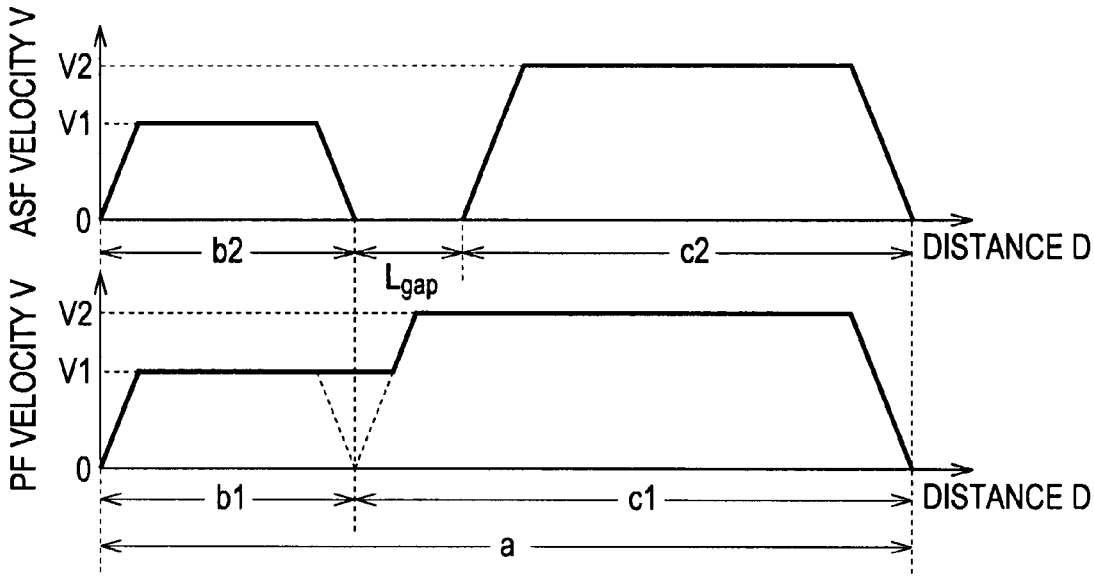
FIG. 11 is a graph showing a speed waveform.

FIG. 11 is a graph showing a speed waveform when the interpage control is performed. In FIG. 11, an upper graph shows the ASF driving and a low graph shows the PF driving. Although the PF driving pauses when the ASF driving pauses at the interpage control position Ng in the first embodiment (see the graph of FIG. 8), the PF driving does not pause when the ASF driving pauses at the interpage control position Ng and the constant speed V1 is changed to the speed V2 at a predetermined timing after the interpage control position Ng in the second embodiment, as shown by the lower graph of FIG. 11. The acceleration/deceleration table VT for changing the speed is not added and the acceleration/deceleration table VT shown in FIG. 6 is used similar to the first embodiment.

The CPU 43 acquires the transporting distance (the paper transporting amount, the ejection amount, or the feeding amount) of the sheet from the header of the printing data. If a value (Nx+a) obtained by adding the transporting distance "a" (PF driving amount) to the current count value Nx (<Ng) of the paper transporting amount counter 65 exceeds the interpage control position Ng ((Nx+a)>Ng), the CPU 43 determines that the interpage control should be performed.

The CPU 43 divides the PF driving amount "a" into the PF driving amount b1 and the PF driving amount c1 (a=b1+c1). Here, the PF driving amount b1 is a distance from the current position Nx before the sheet is transported and the interpage control position Ng. The PF driving amount c1 is a distance from the interpage control position Ng to the transport end position (Nx+a).

The CPU 43 calculates the ASF driving amount b2 from the current position to the interpage control position and the ASF driving amount c2 from a time point when the driving starts after the PF motor 58 is driven by the distance $L_{gap}$ to the transport end position. Accordingly, the PF driving amounts b1 and c1 and the ASF driving amounts b2 and c2 are determined.

In a step S210, a speed (target speed) is selected by the PF driving amount b1 and the ASF driving amount b2. The CPU 43 individually obtains the target speeds corresponding to the PF driving amount b1 and the ASF driving amount b2. The CPU 43 gives the target speeds when receiving the transport command. An acceleration/deceleration table for PF driving and an acceleration/deceleration table for ASF driving are separately prepared. This is because, while pause position precision after transporting the sheet has preference in the PF driving, the reliable transport of the sheet up to the target position has preference in the ASF driving and thus the suitable speed profiles are different in the PF driving and the ASF driving.

First, an acceleration/deceleration table corresponding to the target speed is acquired. If the PF driving amount b1 is equal to or larger than the minimum distance of this acceleration/deceleration table, this acceleration/deceleration table is employed. In contrast, if the PF driving amount b1 is smaller than the minimum distance of this acceleration/deceleration table, the other acceleration/deceleration tables in which the PF driving amount b1 is equal to or larger than the minimum distance are found and, among them, an acceleration/deceleration table having a highest target speed is selected. By this method, with respect to the ASF driving amount b2, a suitable acceleration/deceleration table for ASF driving is selected.

The acceleration/deceleration table for PF driving and the acceleration/deceleration table are determined by the driving amounts b1 and b2. However, when the sheet P1 is nipped between the feeding roller 22 and the retardation roller 24, the feeding roller 22 and the paper transporting roller 29 need to transport the sheet P1 at the same speed. Accordingly, if the target speeds are different in the acceleration/deceleration table for PF driving and the acceleration/deceleration table for ASF driving determined by the driving amounts b1 and b2 (transporting distances), the acceleration/deceleration table is changed such that the target speed is changed to a low target speed. The respective target speeds are determined by determining the acceleration/deceleration table for PF driving and the acceleration/deceleration table for ASF driving. That is, the target speeds, that is, the acceleration/deceleration tables are determined such that the first transporting speeds which are sheet transporting speeds become equal by the ASF driving and the PF driving. For example, the acceleration/deceleration table VT1 having the target speed V1 shown in FIG. 6 is selected.

In a step S220, the speed (target speed) is selected by the PF driving amount c1 and the ASF driving amount b2. Since the previous sheet P1 is released from the nip of the feeding roller 22 after the previous sheet P1 passes through the interpage control position, the PF motor 58 and the ASF motor 56 can be driven at different transporting speeds. Accordingly, when the sheet is transported after passing through the interpage control position, the acceleration/deceleration table satisfying the condition of the minimum distance is determined by the driving amounts c1 and c2 and the target speeds are determined by determining the acceleration/deceleration tables. For example, the acceleration/deceleration table VT2 having the target speed V2 shown in FIG. 6 is selected.

In a step S230, the PF driving amount a (=b1+c1) is set.

In a step S240, a startup timing of the ASF driving c2 is set. That is, since the PF driving end point of the distance $L_{gap}$ after the PF driving b1 (or the ASF driving b2) becomes the startup timing of the ASF driving c2, "b1+$L_{gap}$" is set by a conversion value of the count value of the PF counter 67.

In a step S250, a process of searching for and setting acceleration start timing of the PF driving c1 will be described.

Figure 13:
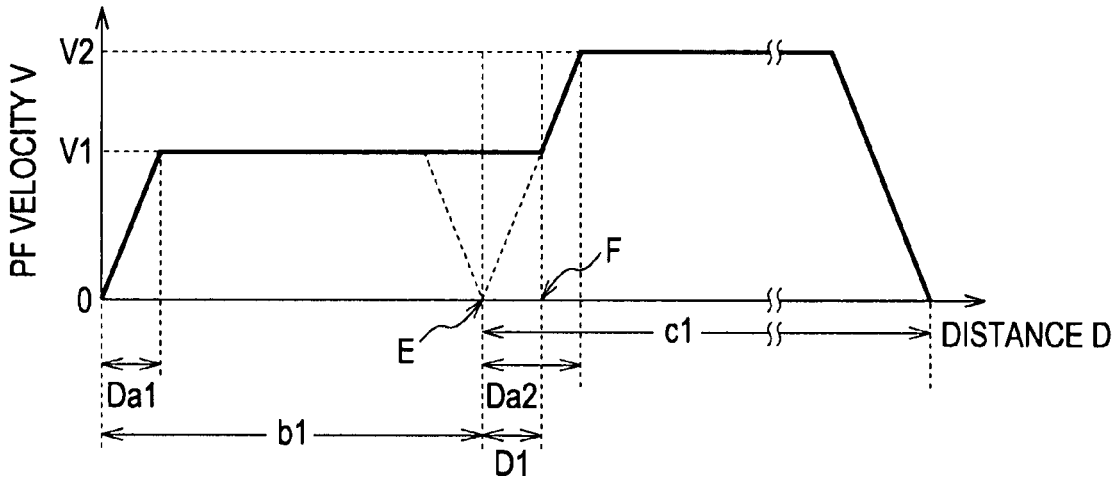
FIG. 13 shows a speed waveform graph and an acceleration table.

That is, first, a constant speed period (value of a target speed period T) "T1" (see FIGS. 6 and 3) in the acceleration/deceleration table VT1 (or the acceleration table VTa1) having the target speed V1 referred at the time of the PF driving b1 is acquired. Subsequently, data of the distance D which is necessary until the period becomes the constant speed period T1 is acquired by referring to the acceleration/deceleration table VT1 or the acceleration table VTa2) of the PF driving amount c1. In the example of FIG. 13, in the acceleration table VTa2, since the distance D at the time of the period "T1" is "D1", the data "D1" of the distance which is necessary until a pause state is changed to the speed of the period "T1" is obtained. The position to which the sheet P1 is transported by the distance of the PF driving amount b1 is the interpage control position Ng. Accordingly, when the sheet P1 reaches the interpage control position Ng, the previous sheet P1 is released from the nip of the feeding roller 22. Thus, the speed of the PF motor 58 may be changed. Accordingly, the speed of the motor may be changed at a timing when the movement of the PF driving amount b1 is finished. In the present embodiment, assuming that acceleration starts from the speed 0 according to the acceleration/deceleration table VT2 at the timing when the movement of the PF driving amount b1 is finished, the acceleration table VTa2 is only referred to (the period is not given). At a timing when the determined period T (speed) reaches the constant speed period T1 (target speed V1) of the acceleration/deceleration table VT1, the acceleration/deceleration table VT1 is switched to the acceleration/deceleration table VT2. By switching the acceleration/deceleration tables VT1 and VT2, two speed profile waveforms based on the two acceleration/deceleration tables VT1 and VT2 are synthesized such that the speed change control for switching the target speed V1 to the target speed V2 is realized.

In a step S260, a reference start position of the PF driving amount c1 is set. That is, since a start point (acceleration table reference start position E) in which the count of the distance data D1 acquired in the step S250 starts corresponds to the PF driving amount b1 until reaching the interpage control position, "b1" is set by the conversion value of the count value of the PF counter 67 as the acceleration table reference start position E. The preparation of the setting of the data necessary for the steps S210 to 260 is finished.

In a step S270, the driving of the ASF motor 56 starts and the driving of the ASF driving amount b2 starts.

In a step S280, the driving of the PF motor 58 starts and the driving of the PF driving amount a starts.

In a step S290, it is determined whether a driving distance Npf of the PF counter 67 reaches the acceleration table reference start position E (Npf≧b1). In the present embodiment, since the acceleration table reference start position E is set to a position where the sheet reaches the interpage control position, when the driving distance Npf counted by the PF counter 67 reaches the PF driving amount b1, it is determined that the driving distance reaches the acceleration table reference start position E. When the driving distance reaches the acceleration table reference start position E, the process progresses to a step S300 and, when the driving distance does not reach the acceleration table reference start position E, the process stands by.

In a step S300, the parameter of the acceleration/deceleration table vT2 of the PF driving amount c1 is set. That is, in order to change the acceleration table VTa1 which has been referred to at that time to the acceleration table VTa2 which will be next used, the distance and the period of the acceleration table VTa2 is set as the parameter.

In a step S310, it is determined whether the driving distance Npf reaches an acceleration start timing position F. If the driving distance Npf counted by the PF counter 67 reaches a value (b1+D1) corresponding to the acceleration start timing position F, the process progresses to a step S320 and, if so not, the process stands by. During the standby, the CPU 43 referring to the acceleration table VTa2 from the acceleration table reference start position E. However, until the distance P from the acceleration table reference start position E reaches "D1", the distance P is only referred to and the period T corresponding to the distance P is not given.

In a step S320, the acceleration table VTa2 of the PF driving amount is applied. The distance "D1" corresponding to the same period "T1" as the constant speed period "T1" is applied as a reference start position. The CPU 43 switches the referred acceleration table from the acceleration table VTa1 to the acceleration table VTa2 and starts the speed control according to the acceleration table VTa2 from the reference start position D1.

In a step S330, it is determined whether the driving distance Npf of the PF counter 67 reaches a start timing when the feeding of the ASF driving amount c2 starts. That is, it is determined whether the sheet is moved by the distance $L_{gap}$ after the PF driving amount reaches "b1". In more detail, it is determined whether the driving distance Npf counted by the PF counter 67 reaches "b1+$L_{gap}$". It may be determined whether the PF counter 67 counts the value of "$L_{gap}$" after "b2" is counted by the ASF counter 66. If the sheet is moved by the distance $L_{gap}$ after the PF driving amount reaches "b1" such Npf≧b1+$L_{gap}$ is satisfied, the process progresses to a step S340. If the sheet is not moved by the distance $L_{gap}$, the process stands by until the sheet is moved by the distance $L_{gap}$.

In a step S340, the ASF driving c2 starts. After the ASF driving is stopped and the PF driving is then performed by the distance $L_{gap}$, the ASF driving is resumed.

Figure 12:
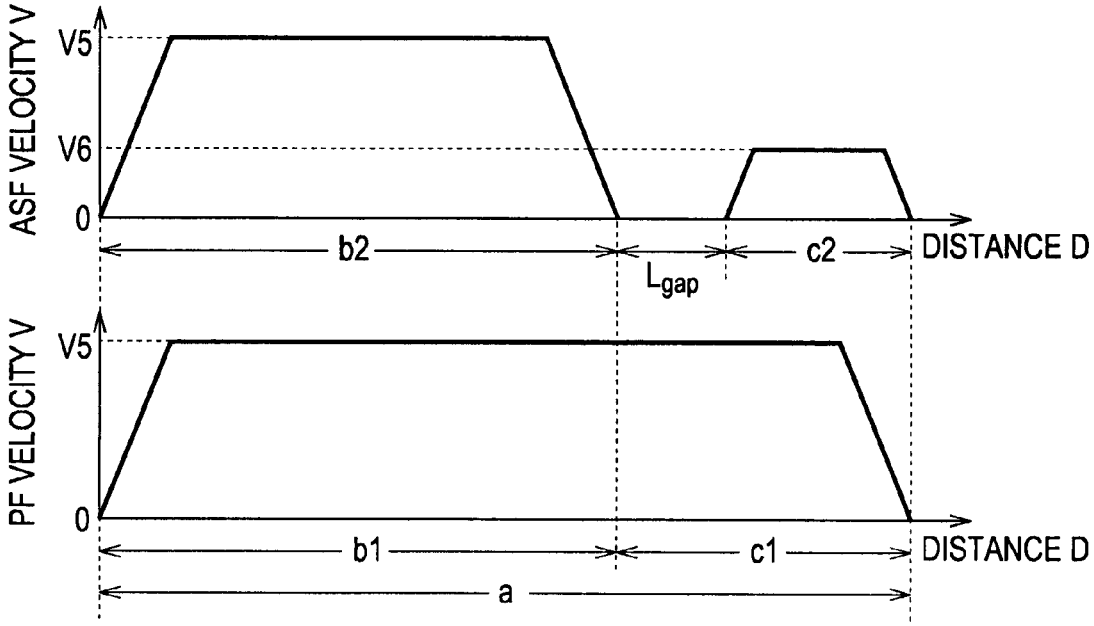
FIG. 12 is a graph showing a speed waveform.

Although the magnitude relation between the PF driving amount b1 and the PF driving amount c1 obtained by dividing the PF driving amount a is b1<c1 in the present embodiment, as shown in FIG. 12, the magnitude relation may be b1>c1. In this case, the ASF driving is stopped after the driving of the ASF driving amount b2 is finished and then the acceleration of the ASF driving amount c2 starts after the PF driving amount becomes the interpage control distance $L_{gap}$. In this case, the PF driving speed is changed according to the acceleration/deceleration table determined by the PF driving amount a (acceleration/deceleration determined by the target speed and the acceleration/deceleration table determined by the ASF driving amount b2) so as to have two constant speed ranges without deceleration. Accordingly, it is possible to prevent the sheet P1 from being delayed until reaching a next recording position.

In the second embodiment, in the steps S50 and S110 of FIG. 10, the previous sheet P1 is transported to the interpage control position Ng by the ASF driving and the PF driving and the process of stopping the ASF driving corresponds to the step of stopping or decelerating the feeding device (the stopping step, in the present embodiment). In the steps S60 and S120, a process of starting the acceleration of the ASF driving after the gap between the sheets P1 and P2 reaches the interpage control distance $L_{gap}$ corresponds to a control step. In FIG. 14, the steps 240 to S320 correspond to a speed change step.

As described above in detail, according to the present embodiment, the following effects can be obtained.

6) While the sheet is inserted between the feeding roller 22 and the retardation roller 24, the ASF motor 56 and the PF motor 58 need to be driven such that the feeding roller 22 and the paper transporting roller 2 are rotated at the same speed. In the transport over the interpage control position, an acceleration/deceleration table having a highest speed is selected from the acceleration/deceleration table having the minimum distance equal to or smaller than the transporting distance up to the interpage control position and the target speeds of the ASF and the PF are adjusted to a low speed. Accordingly, in the interpage control position which divides a range from the transport start position to the transport end position (the feeding position or the paper transporting position, if the first transporting distance is larger than the second transporting distance, the feeding does not pause although a high target speed can be set to the feeding speed after the interpage control position. If the sheet is continuously transported to the transport end position (the feeding position or the paper transporting position), the feeding should be performed at a low speed according to the paper transporting speed determined by the first transporting distance b1 although the second transporting distance c1 is long. However, in the present embodiment, since the speed of the PF motor 58 is changed when the sheet reaches the interpage control position and the ASF motor 58 pauses, the feeding can be performed compared with the first embodiment in which the PF motor 58 pauses. If the second transporting distance c1 is larger than the first transporting distance b1, since the previous sheet P can be transported at the second transporting speed V2 higher than the first transporting speed V1, the predetermined gap $L_{gap}$ or more can be ensured between the previous sheet P1 and the next sheet P2 and the printing throughput can be improved.

(7) In the transporting operation over the interpage control position Ng, when the next sheet P2 which is transported to the interpage control position Ng waits until the gap $L_{gap}$ or more is ensured between the previous sheet P1 and the next sheet P2, the acceleration is performed without giving pause to the driving of the PF motor 58. Accordingly, the acceleration/deceleration table having one constant speed (target speed) can be used and a configuration in which the acceleration/deceleration table for changing the speed, having a plurality of target speeds (constant speeds) including the first transporting speed and the second transporting speed, is separately added may not be employed. If the acceleration/deceleration table for changing the speed is employed, a plurality of combinations of acceleration/deceleration tables should be added for a plurality of target speeds. However, in the present embodiment, the acceleration/deceleration tables may not be combined. Accordingly, a storage capacity of a memory does not need to be increased or a memory does not need to be added.

(8) If the first transporting distance b1 is larger than the second transporting distance c1, the first transporting speed V1 which is the target speed of the acceleration/deceleration table determined by the transporting distance is lower than the second transporting speed, but the sheet is transported at the first transporting speed V1 without reduction of the first transporting speed (that is, without reduction of the second transporting speed) Accordingly, the feeding can be performed at a high speed compared with a configuration in which the speed is reduced.

The invention is not limited to the above-described embodiment and the following examples may be employed.

Modified Example 1

Figure 15:
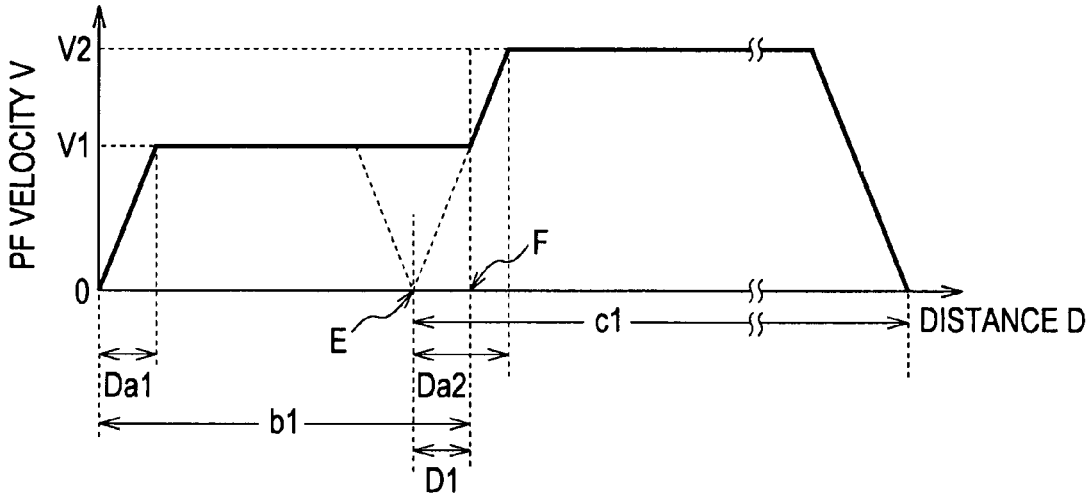
FIG. 15 is a graph showing a speed waveform of a modified example.

Although the position where the driving of the PF driving amount b1 is finished, that is, the interpage control position, is set to the acceleration table reference start position in the second embodiment, the invention is not limited to this. For example, as the acceleration table reference start position E, a position where the sheet is released from the nip of the feeding roller 22 when reaching an acceleration start timing position F is sufficient. For example, a position before reaching the interpage control position Ng is set to the acceleration table reference start position and acceleration starts from the acceleration start timing position for measuring the distance D1 from the acceleration table reference start position. The timing when the sheet is transported and released from the nip of the feeding roller 22 is sufficient. For example, as shown in FIG. 15, a value "B1−D1" obtained by subtracting the distance D1 at the time of constant speed period T1 from the acceleration table VTa2 from b1 is set to the reference start position and the position b1 where the sheet is moved from the reference start position by the distance D1 is set to the acceleration start timing. By this configuration, the acceleration can start at a timing immediately after the sheet is released from the nip between the feeding roller 22 and the retardation roller 24. Although the increase of the PF driving speed starts, the feeding can be performed while maintaining the predetermined gap $L_{gap}$ between the previous sheet and the next sheet.

While the PF driving speed is maintained at an initial constant speed range, the ASF driving speed is decreased. However, the ASF driving speed is slowly decreased compared with the PF driving speed during the deceleration. When the predetermined gap $L_{gap}$ is ensured during deceleration, the ASF driving speed is immediately increased after pause such that a pause standby time may be substantially set to "0". The increase of the ASF driving c2 may start during deceleration before pause. At this time, a speed changing method is performed by as the same method as the PF driving amount.

Even when the increase of the ASF driving c2 starts at the time of pause or decrease of the ASF driving b2, the gap between the previous sheet and the next sheet is gradually increased in a period in which the ASF driving speed is lower than the PF driving speed. Accordingly, at a timing when the ASF driving speed is increased during pause or deceleration, the predetermined gap $L_{gap}$ may not be ensured. The predetermined gap $L_{gap}$ between the previous sheet and the next sheet may be ensured until the next sheet is transported to the position where the front end of the fed next sheet is detected by the paper detection sensor 33.

Modified Example 2

Figure 16:
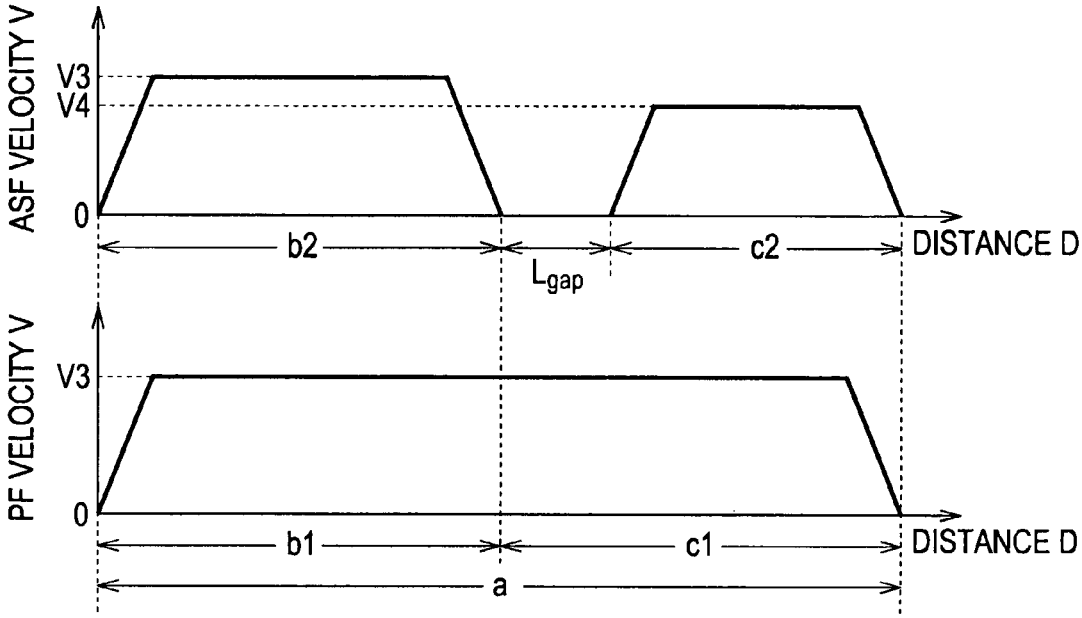
FIG. 16 is a graph showing a speed waveform of another modified example.

Although the PF motor 58 pauses when the ASF motor 56 pauses even under a condition in which the first transporting speed and the second transporting speed are identical in the first embodiment, the invention is not limited to this. For example, as shown in FIG. 16, under a condition in which the first transporting speed V3 determined by the minimum distance condition of the acceleration/deceleration table VT from the driving distance b2 and the second transporting speed V3 determined by the minimum distance condition of the acceleration/deceleration table VT from the driving distance c1, the PF motor 58 does not pause even when passing the interpage control position Ng and are driven by the driving distance a at the first transporting speed V3. The CPU 43 obtains a highest target speed (first transporting speed) among the target speeds set in the acceleration/deceleration table VT satisfying the condition that the ASD driving distance b2 is equal to or larger than the minimum distance and obtains a highest target speed (second transporting speed) among the target speeds set in the acceleration table VT satisfying the condition that the PF driving distance c1 is equal to or larger than the minimum distance. Then, it is determined whether the first transporting speed and the second transporting speed are identical. If the first transporting speed and the second transporting speed are identical, the CPU 43 drives the PF motor 58 by the PF driving distance a (=b1+c1). If the first transporting speed and the second transporting speed are not identical, the PF motor 58 are driven by the PF driving distance b1 and the PF driving distance c1.

Here, the first transporting speed and the second transporting speed may be identical in a predetermined allowable range. For example, when the second driving in which the driving of the PF driving distance a is performed at once completes the transport of the sheet in a short time compared with the first driving in which the PF motor 58 pauses, an allowable range is given to the determination such that the first transporting speed and the second transporting speed are identical although the speeds are slightly different. A transporting time consumed when the PF motor 58 pauses and is switched to a high speed and a transporting time consumed when the driving is performed by the PF driving distance at the first transporting speed without pausing are calculated using data of the acceleration/deceleration table VT. If the latter transporting time is smaller than the former transporting time, a configuration in which the second driving which performs driving by the PF driving distance a at once may be employed by the latter method. By this configuration, since the sheet can be fast transported to the printing position, the printing throughput can be improved. Since the previous sheet does not pause, the transporting time consumed when the previous sheet P1 is transported by the interpage control distance $L_{gap}$ after the pause of the ASF motor 56 is reduced and thus a standby time in which the ASF motor 56 waits for the PF driving of the interpage control distance $L_{gap}$ is reduced. For example, when the sheet passes through the interpage control position Ng during ejection, the feeding (detection) of the next sheet can be fast finished. Accordingly, since a print start time is advanced, it is possible to suppress the deterioration of the printing throughput.

Modified Example 3

In the first embodiment, if it is determined that the sheet exceeds the interpage control page Ng in the step S30 of FIG. 10, the sheet is transported at the first transporting speed by the distance from the transport start position (previous pause position) to the interpage control position Ng (predetermined position) and is transported at the second transporting speed by the distance from the interpage control position Ng to the transport end position (next pause position). As a result, when a condition that the second transporting speed is larger than the first transporting speed is satisfied, the PF motor 58 pauses at the interpage control position Ng (predetermined position)

and the first transporting speed is changed to the second transporting speed before and after the pause. At this time, if the relationship between the transporting speeds before and after the pause at the predetermined position of the ASF motor 56 satisfies the condition that the second transporting speed is larger than the first transporting speed, the PF motor 58 pauses. If the relationship between the transporting speeds before and after the pause at the predetermined position of the PF motor 58 satisfies the condition that the second transporting speed is larger than the first transporting speed, the PF motor 58 pauses. In contrast, the following configuration may be employed. That is, if it is determined that the sheet exceeds the interpage control position Ng (S30), the first transporting speed and the second transporting speed are acquired by referring to the acceleration/deceleration table (speed control data) from the transporting distance (first transporting distance) from the transport start position to a predetermined position and the transporting distance (second transporting distance) from the predetermined position to the paper transporting end position. Then, it is determined whether the second transporting speed is higher than the first transporting speed. In this case, the first transporting speed and the second transporting speed are used as the transporting speed of the PF motor 58, but may be used as the transporting speed of the ASF motor 56. If the first and second transporting speeds are used as the transporting speed of the PF motor 58, the first transporting speed determined by the transporting distance b1 and the second transporting speed determined by the transporting distance c1 are compared. In contrast, if the first and second transporting speeds are used as the transporting speed of the ASF motor 56, the first transporting speed determined by the transporting distance b2 and the second transporting speed determined by the transporting distance c2 (or $L_{gap}$+c2) are compared. In either case, if the condition that the second transporting speed is larger than the first transporting speed is satisfied, the driving of the PF motor pauses at a predetermined position. With respect to a ratio of the first transporting speed to the second transporting speed, since there is positive correlation between the ASF driving and the PF driving, when the condition that the second transporting speed is larger than the first transporting speed is satisfied by the ASF driving, the condition that the second transporting speed is larger than the first transporting speed is satisfied even by the ASF driving. This configuration is applicable to the second embodiment. In the second embodiment, the second transporting speed is obtained by the transporting distance from the acceleration table reference start position E to the next pause position.

Modified Example 4

Although the interpage control position is set to the downstream position G of the nip point between the feeding roller 22 and the retardation roller 24 in the feeding direction in the above embodiment, the interpage control position is not limited to this. The interpage control position may be the downstream position of the nip point in the feeding direction and the upstream side of the detection position of the paper detection sensor 33 in the transporting direction. If the interpage control position is set at a position in a range from the nip point of the feeding roller and the detection position, the interpage control can be previously performed to ensure the gap $L_{gap}$ until the next sheet is transported to the position where the front end of the next sheet is detected.

Modified Example 5

Although the acceleration/deceleration table is included in the above embodiment, the acceleration/deceleration table may not be included. The acceleration and the deceleration are set by a straight line gradient such that a period per distance (speed) in an acceleration range and a deceleration range may be obtained using a computation using a linear equation. For example, if an acceleration gradient is A and the distance is Dx, the period Ta is calculated by Ta=A·Dx. Even in the deceleration range, if a deceleration gradient is −B, the period Ta is calculated by Ta=−B·Dx. In at least one of the acceleration range and the deceleration, at least one point in which the gradient of the acceleration or the deceleration is changed may be set. Even in this case, the period per distance can be calculated by simple calculation.

Modified Example 6

The pause of the transporting device when changing the first transporting speed to the second transporting speed is not limited to the feed start standby of the previous medium by the feeding device. When passing through an area in which the sheet is transported by the feeding device (feeding roller 22) and the transporting device (paper transporting roller 29), the transporting device may pause while the sheet is transported by the feeding device. For example, the transporting device may pause before the feeding device pauses and after the start of the feeding of the next medium.

Modified Example 7

Although the ASF motor 56 and the PF motor 58 are separately provided and the feeding roller 22 and the paper transporting roller 29 are driven by the respective driving sources in the above embodiment, the feeding roller 22 and the paper transporting roller 29 may be driven by one motor driving source). In this case, the feeding roller 22 pauses at a predetermined position by detaching the motor using an electronic clutch.

Modified Example 8

In a case where the transporting speeds (target speed) of the PF motor 58 determined by the transporting distances before and after the interpage control position Ng are different when the sheet is transported to pass through the interpage control position Ng, the PF driving pauses in the first embodiment and a combination of speed profiles determined by the acceleration/deceleration table is controlled in the second embodiment. An acceleration/deceleration table (speed control data) for combining two speed profiles having different target speeds to generate a speed profile having two different target speeds (constant speeds) may be provided.

Modified Example 9

When the sheet is transported over the interpage control position Ng, the sheet pauses at the interpage control position Ng, and the ASD driving starts to feed the next sheet after the previous sheet is transported by the interpage control distance $L_{gap}$ by the PF driving. In contrast, the ASF driving may start without waiting for the interpage control distance $L_{gap}$ and the ASF driving may pause at a time point when reaching the feeding distance smaller than the transporting distance of the PF driving by the interpage control distance $L_{gap}$. Even in this configuration, when the transport of the sheet is finished and thus the ASF driving and the PF driving are stopped, it is possible to ensure the predetermined gap between the rear end of the previous sheet and the front end of the next sheet.

Modified Example 10

The driving source is not limited to a DC motor and another electric motor may be used. For example, a stepping motor may be used. As the stepping motor, for example, a 2-phase excitation method, a 1-phase excitation method, a 1-2-phase excitation method, or a micro step driving (vernier driving) method may be employed. A rotator may be of a permanent magnet type (PM type), a variable reluctance type (VR type), or a hybrid type (HB type).

Modified Example 11

Although the driving control of the ASF motor and the PF motor is realized by software by allowing the CPU 43 to execute the program in the present embodiment, the invention is not limited to the method using the software. For example, the sheet feeding/transporting control process may be realized by hardware such as a control circuit (custom IC or the like) or the sheet feeding/transporting control process may be realized by a combination (cooperation) of hardware and software.

Modified Example 12

The printer is not limited to the ink jet printer. The invention is applicable to other serial printers such as a dot impact type printer. The invention is applicable to a recording apparatus which includes a line head type recording head having a nozzle for recording data over the entire width of a sheet and records data on a medium while the recording head is not moved in the main scanning direction. In this case, the medium recorded by the line head is transported at a constant speed in a transporting direction and recording is performed on the medium which is being moved in the transporting direction by the line head.

Modified Example 13

Although the ink jet printer is used as the recording apparatus in the present embodiment, the invention is applicable to a liquid ejection type recording apparatus for ejecting liquid other than ink. The term "recording" is not limited to recording using printing and may include recording which is performed by ejecting liquid including a material used in, for example, a wiring pattern of a circuit and drawing the wiring pattern on a substrate as a medium. For example, a liquid ejecting apparatus (recording apparatus) for ejecting a material in which a material such as an electrode material or a color material used for manufacturing a liquid crystal display, an electroluminescence (EL) display and a surface light-emitting display is dispersed or dissolved may be employed. In this case, a predetermined pattern such as a pixel pattern or a wiring pattern is drawn on a substrate by ejecting a liquid droplet. For example, when sheet-shaped substrates are sequentially transported one by one by a transporting device and a predetermined pattern such as a wiring pattern is drawn on a transported substrate by a recording device using a liquid ejecting method, the speed can be changed even when a complicated speed control method is not used at a gap between substrates as a medium. Thus, throughput can be improved and productivity can be improved.

Hereinafter, technical spirits according to the embodiment and the modified examples will be described.

(1) In the recording apparatus, the previous minimum may be transported at the first transporting speed without changing the speed, under a condition in which the first transporting speed and the second transporting speed are substantially identical.

(2) When the previous medium passes through the predetermined position, under a condition that a second transporting speed which is a transporting speed of the previous medium by the transporting device after the transport of the next medium has been started by the feeding device is higher than a first transporting speed which is a transporting speed of the previous medium by the feeding device and the transporting device, the speed of the transporting device may be changed from the first transporting speed to the second transporting speed.

(3) The combination may be performed by giving a speed according to a position from a position value corresponding to a speed of a constant speed range of the first speed control data in the second speed control data.

(4) The first speed control data and the second speed control data may be speed control data each including on data group indicating a correspondence between the position value and the speed value in an acceleration process and a deceleration process.

(5) The second transporting speed may be determined by selecting a highest transporting speed among the transporting speeds satisfying a condition that a residual transporting distance in which the medium is transported at the first transporting speed is equal to or larger than a minimum distance.

(6) The recording apparatus may further include a detection device for detecting a front end of the next medium between engagement positions where the feeding device and the transporting device apply a transporting force to the medium, and the predetermined position may be set to a upstream position of a position where the previous medium can be detected by the detection device in a transporting direction.

(7) The recording apparatus may further include a storage device for storing the first speed control data which is set according to the position value and has the first transporting speed as a target speed and the second speed control data which is set according to the position value and has the second transporting speed as the target speed. In the medium transporting method, in the changing of the speed, the speed may be changed from the first transporting speed to the second transporting speed by switching speed control data, which is referred in order to control the speed of the transporting device, from one of the first speed control data to one of the second speed control data corresponding thereto in an acceleration process.

What is claimed is:

1. A recording apparatus including a feeding device for feeding a previous medium, which is fed first, and a next medium, which is fed after the previous medium, a transporting device for transporting the previous medium and the next medium fed by the feeding device, and a recording device for recording data on the previous medium and the next medium transported by the transporting device, the recording apparatus comprising:

a control device which controls a transportation of the medium by controlling the feeding device and the transporting device; and an ejecting device for ejecting the medium and which is synchronized with the transporting device;

wherein, first, the previous medium is transported by the feeding device and the transporting device at a first transporting speed to a predetermined position where the previous medium is no longer being transported by the feeding device, and the previous medium is transported only by the transporting device, second, the feeding device is decelerated so that a gap between the previous medium and the next medium becomes a predetermined distance, and third, the next medium is accelerated by the feeding device and the next medium is transported by the feeding device at a second transporting speed, different from the first, so as to continuously transport the previous medium and the next medium; and wherein, the control device controls to change the speed of the transporting device from the first transporting speed to the second transporting speed when the previous medium passes through the predetermined position, in response to a condition that the first transporting speed of the previous medium by the feeding device and the transporting device is different from the second transporting speed of the next medium by the feeding device.

2. The recording apparatus according to claim 1, wherein:

the transporting device does not pause when the first transporting speed is changed to the second transporting speed, the first transporting speed is the transporting speed of the transporting device after the previous medium is transported to a predetermined position, and the control device performs a control which satisfies a relationship in which the second transporting speed is higher than the first transporting speed in accordance with a transporting distance.

3. The recording apparatus according to claim 2, wherein the control device does not change the speed of the transporting device from the first transporting speed to the second transporting speed under a condition that the second transporting speed is lower than the first transporting speed.

4. The recording apparatus according to claim 2, further comprising:

a first driving source which drives the feeding device; and a second driving source which drives the transporting device, wherein the control device controls the driving of the first driving source and the second driving source, and wherein the second transporting speed depends on a transporting distance from the predetermined position to a pause position of the first driving source or a transporting distance from a position in which the speed is 0 to a pause position of the second driving source.

5. The recording apparatus according to claim 1, wherein:

the transporting device pauses when the first transporting speed is changed to the second transporting speed, and the control device performs a control which satisfies a relationship in which the second transporting speed is higher than the first transporting speed in accordance with a transporting distance.

6. The recording apparatus according to claim 5, wherein the control device does not pause the transporting device even when the feeding device pauses at the predetermined position and waits for the start of the feeding of the next medium, under a condition in which the first transporting speed and the second transporting speed are substantially identical.

7. The recording apparatus according to claim 5, further comprising:

a first driving source which drives the feeding device; and a second driving source which drives the transporting device, wherein the control device controls the driving of the first driving source and the second driving source, and wherein the second transporting speed depends on a transporting distance from the predetermined position to the next pause position of the first driving source or a transporting distance from the predetermined position to the next pause position of the second driving source.

8. The recording apparatus according to claim 1, further comprising a motor connected to the transporting device and to the ejection device, wherein the control device controls the motor to drive the transporting device and the ejection device.

9. The recording apparatus according to claim 8, further comprising a second motor, wherein the control device controls the second motor to drive the feeding device.

10. The recording apparatus according to claim 9, further comprising:

a first encoding device that outputs a first signal to the control device indicating a rotation speed of the motor; and a second encoding device that outputs a second signal to the control device indicating a rotation speed of the second motor, wherein the control device controls the motor to drive the transporting device and the ejection device based at least in part of the first signal, and the control device controls the second motor to drive the feeding device based at least in part of the second signal.

* * * * *